US012799713B2

(12) United States Patent
Ito et al.

(10) Patent No.: US 12,799,713 B2
(45) Date of Patent: Nov. 17, 2026

(54) AUTOMATED CONTROL SYSTEM FOR WORK MACHINE WITH STABILITY DETERMINATION

(71) Applicant: HITACHI CONSTRUCTION MACHINERY CO., LTD., Tokyo (JP)

(72) Inventors: Masamichi Ito, Toride (JP); Shinjiro Yamamoto, Amimachi (JP); Yuichi Ogawa, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 18/842,448

(22) PCT Filed: Mar. 30, 2022

(86) PCT No.: PCT/JP2022/016063
§ 371 (c)(1),
(2) Date: Aug. 29, 2024

(87) PCT Pub. No.: WO2023/188131
PCT Pub. Date: Oct. 5, 2023

(65) Prior Publication Data
US 2025/0163678 A1 May 22, 2025

(51) Int. Cl.
*E02F 9/20* (2006.01)

(52) U.S. Cl.
CPC ..... *E02F 9/205* (2013.01)

(58) Field of Classification Search
CPC ..... E02F 9/205
See application file for complete search history.

(56) References Cited

U.S. PATENT DOCUMENTS

2017/0251587 A1* 9/2017 Sporrer ..... A01B 15/14
2020/0032488 A1* 1/2020 Kean ..... E02F 9/262
(Continued)

FOREIGN PATENT DOCUMENTS

JP 11-36372 A 2/1999
JP 2020020153 A 2/2020
WO 2020/002439 A1 1/2022

OTHER PUBLICATIONS

International Search Report of PCT/JP2022/016063 dated Jun. 14, 2022.

(Continued)

*Primary Examiner* — Jess Whittington
(74) *Attorney, Agent, or Firm* — MATTINGLY & MALUR, PC

(57) ABSTRACT

Provided is an automated control system for a work machine capable of suppressing deterioration of the workability in automated work caused by instability of the ground for the work machine. An automated traveling control section 703 performs automated traveling of the work machine; an automated work control section (automated excavation control section 704) performs automated work of the work machine; and a stability determination section 702 determines stability of ground for the work machine. When execution of automated traveling control by the automated traveling control section 703 is to be followed by execution of automated work control by the automated work control section (automated excavation control section 704), stability determination by the stability determination section 702 is executed before executing the automated work control, and automated control of the work machine is executed on the basis of a determination result obtained by the stability determination section 702.

4 Claims, 25 Drawing Sheets

(56) References Cited

U.S. PATENT DOCUMENTS

| | | | | |
|---|---|---|---|---|
| 2020/0407949 | A1 | 12/2020 | Aizawa et al. | |
| 2021/0094535 | A1* | 4/2021 | Thompson | B60W 40/06 |
| 2021/0116601 | A1* | 4/2021 | Sherlock | G01W 1/02 |
| 2021/0131072 | A1* | 5/2021 | Gratton | E02F 9/0841 |
| 2021/0246626 | A1* | 8/2021 | Yamamoto | G08B 21/24 |
| 2021/0285187 | A1* | 9/2021 | Jagoda | E02F 9/2041 |
| 2022/0126816 | A1* | 4/2022 | Von Holst | E02F 9/2058 |
| 2022/0154431 | A1* | 5/2022 | Kurosawa | E02F 3/435 |
| 2023/0257958 | A1* | 8/2023 | Binstock | E02F 9/16 414/722 |
| 2024/0026651 | A1* | 1/2024 | Nishi | E02F 9/2054 |
| 2024/0229373 | A1* | 7/2024 | Chen | E01C 19/264 |
| 2024/0272645 | A1* | 8/2024 | Hayashida | G05D 1/6484 |
| 2025/0075470 | A1* | 3/2025 | Satoh | E02F 9/24 |

OTHER PUBLICATIONS

Communication Pursuant to Rule 114(2) EPC received in corresponding European Application No. 22935277.8 dated Sep. 3, 2026.

* cited by examiner

Fig. 11

| No. | Control | Target position | | |
|---|---|---|---|---|
| | | X | Y | Z |
| 1 | Automated traveling | Tx1 | Ty1 | — |
| 2 | Automated traveling | Tx2 | Ty2 | — |
| 3 | Automated excavation | Dx1 | Dy1 | Dz1 |
| 4 | Automated excavation | Dx2 | Dy2 | Dz2 |
| 5 | Automated excavation | Dx3 | Dy3 | Dz3 |
| 6 | END | — | — | — |

Insert stability determination at S420

| No. | Control | Target position | | |
|---|---|---|---|---|
| | | X | Y | Z |
| 1 | Automated traveling | Tx1 | Ty1 | — |
| 2 | Automated traveling | Tx2 | Ty2 | — |
| 3 | Stability determination | — | — | — |
| 4 | Automated excavation | Dx1 | Dy1 | Dz1 |
| 5 | Automated excavation | Dx2 | Dy2 | Dz2 |
| 6 | Automated excavation | Dx3 | Dy3 | Dz3 |
| 7 | END | — | — | — |

| No. | Control | Target position | | |
|---|---|---|---|---|
| | | X | Y | Z |
| 1 | Automated traveling | Tx1 | Ty1 | — |
| 2 | Automated traveling | Tx2' | Ty2' | — |
| 3 | Stability determination | — | — | — |
| 4 | Automated traveling | Tx2 | Ty2 | — |
| 5 | Automated excavation | Dx1 | Dy1 | Dz1 |
| 6 | Automated excavation | Dx2 | Dy2 | Dz2 |
| 7 | Automated excavation | Dx3 | Dy3 | Dz3 |
| 8 | END | — | — | — |

AUTOMATED CONTROL SYSTEM FOR WORK MACHINE WITH STABILITY DETERMINATION

TECHNICAL FIELD

The present invention relates to an automated control system for a work machine.

BACKGROUND ART

Generally, a work machine, such as a hydraulic excavator, includes a traveling body that travels and an upper turning body turnably provided on the traveling body.

Patent Literature 1 describes a technique of automating work of such a work machine.

CITATION LIST

Patent Literature

Patent Literature 1: JP 2020-020153 A

SUMMARY OF INVENTION

Technical Problem

In Patent Literature 1, for example, a digging start point of a work device is determined on the basis of topographical data indicative of a topography measured by a topography sensor that measures a topography, and the work device is moved from a current position of the work device to the digging start point. Such a technique of automating the work machine as in Patent Literature 1 is based on the assumption that the ground is stable.

However, work machines such as excavators may travel on uneven terrain. For example, when the operation of the excavator including traveling is to be automated, an unstable ground toward which the excavator is traveling may cause poor stability in planned work to be automated, and the workability may be affected.

In view of the above circumstances, the present invention has been made to solve these problems, and it is an object of the present invention to provide an automated control system for a work machine capable of suppressing deterioration of the workability in automated work caused by instability of the ground for the work machine.

Solution to Problem

To solve the above problems, the automated control system for a work machine of the present invention is an automated control system for a work machine, comprising: a work machine including a plurality of driven members that is driven by a plurality of actuators; and a control device that controls the work machine. The control device includes: an automated traveling control section that performs automated traveling of the work machine; an automated work control section that performs automated work of the work machine; and a stability determination section that determines stability of ground for the work machine. When execution of automated traveling control by the automated traveling control section is to be followed by execution of automated work control by the automated work control section, the control device executes stability determination by the stability determination section before executing the automated work control, and executes automated control of the work machine on the basis of a determination result obtained by the stability determination section.

Advantageous Effects of Invention

According to the present invention, it is possible to reduce workability loss due to the automated control inadvertently started on an unstable ground.

Other problems, configurations, and advantageous effects will become apparent from the following description of embodiments.

BRIEF DESCRIPTION OF DRAWINGS

FIG. 11 is a diagram illustrating an operation example of the first embodiment.

DESCRIPTION OF EMBODIMENTS

Figure 1:
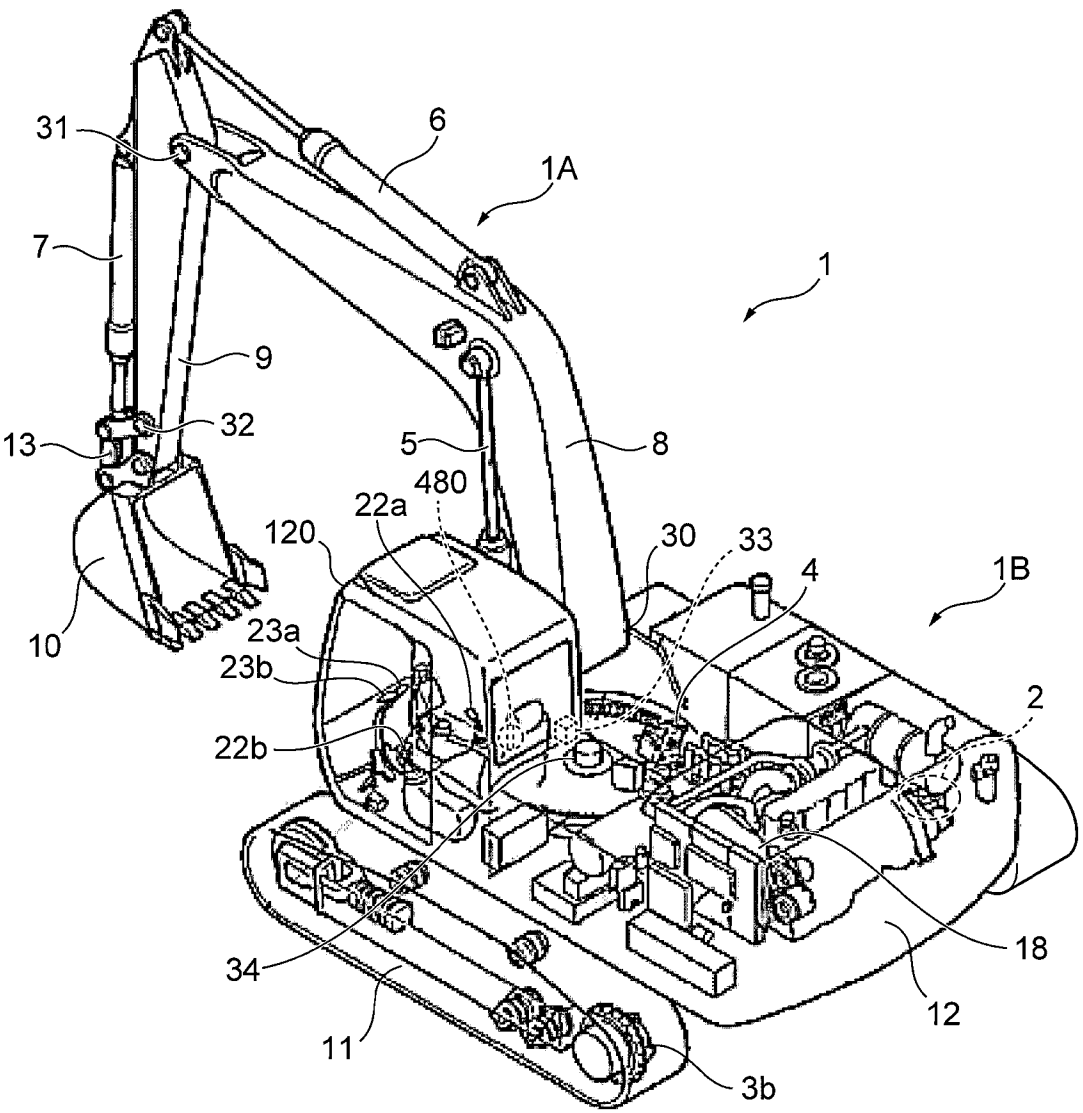
FIG. 1 is a configuration diagram of a hydraulic excavator.

Hereinafter, embodiments of the present invention will be described by referring to the accompanying drawings. In each drawing, the same reference numeral is given to a part having the same function and the repeated description may be omitted. Note that although a hydraulic excavator provided with a bucket 10 as a work implement (attachment) at the end of the work device will be described by way of example, the present invention is applicable to a hydraulic excavator provided with a work implement other than the bucket, or to work machines other than the hydraulic excavator.

Further, in the following description of the present specification, in a case where there is a plurality of the same constituent elements, alphabets may be given to the ends of the reference numerals (numbers), but the plurality of such constituent elements may be collectively denoted without the alphabets. For example, when two pumps 2*a*, 2*b* are present, these may be collectively denoted as a pump 2.

First Embodiment

<Basic Configuration>

Figure 2:
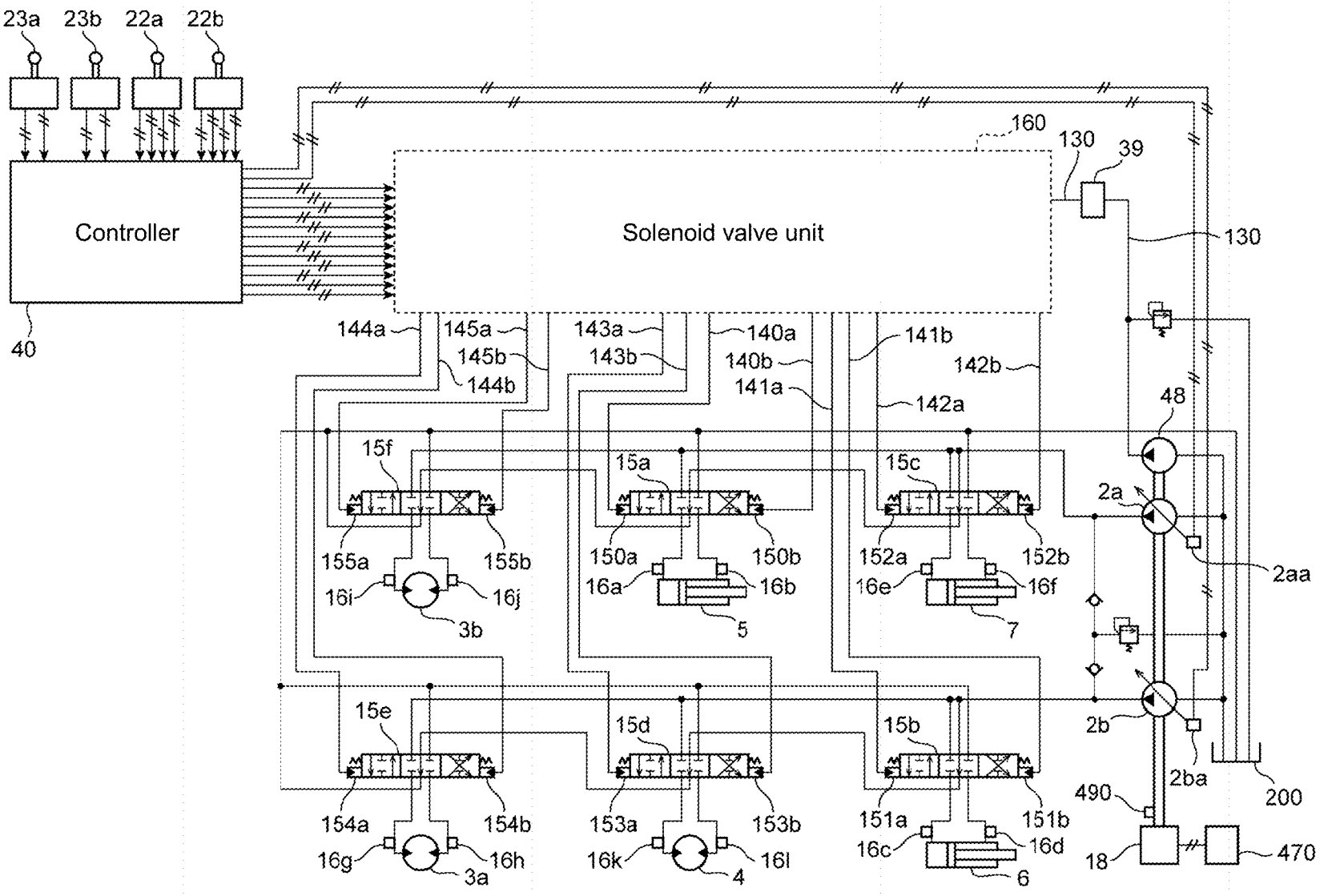
FIG. 2 is a diagram illustrating a controller of the hydraulic excavator, together with a hydraulic drive device.
Figure 3:
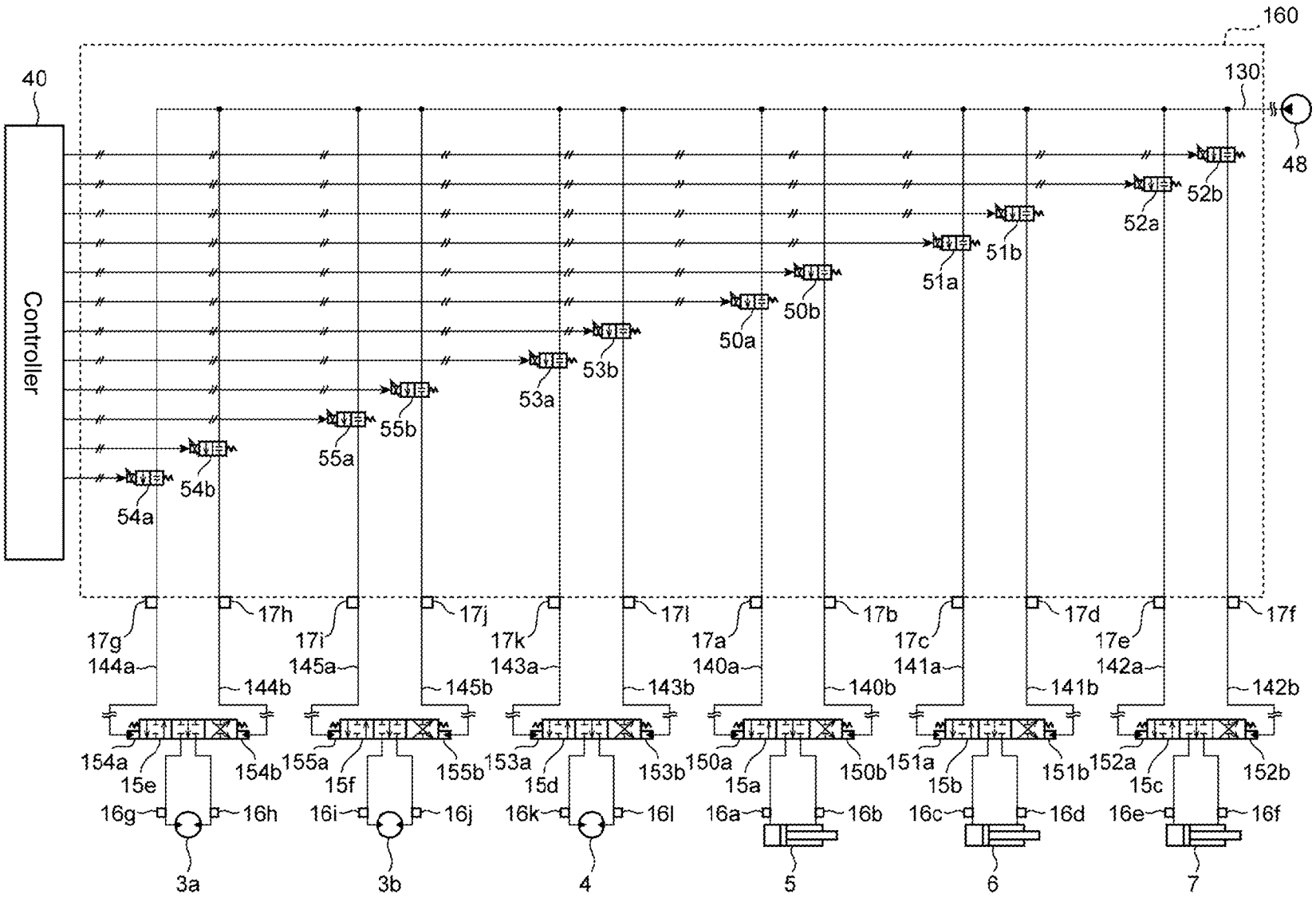
FIG. 3 is a detailed diagram of a solenoid valve unit.

FIG. 1 is a configuration diagram of a hydraulic excavator according to the first embodiment of the present invention. FIG. 2 is a diagram illustrating a controller of the hydraulic excavator according to the first embodiment of the present invention, together with a hydraulic drive device. FIG. 3 is a detailed diagram of a solenoid valve unit 160 in FIG. 2.

In FIG. 1, a hydraulic excavator 1 includes a front work device 1A of an articulated type, and a machine body 1B. The machine body 1B is made up of a lower traveling body 11 that travels by means of left and right traveling hydraulic motors 3*a* (FIG. 2, FIG. 3), 3*b* (the right traveling hydraulic motor 3*a*, the left traveling hydraulic motor 3*b*), and an upper turning body 12 mounted on the lower traveling body 11 and configured to turn by means of a turning hydraulic motor 4.

The front work device 1A includes a plurality of driven members (a boom 8, an arm 9, and a bucket 10) coupled with each other, each rotatably moving in the vertical direction. The proximal end of the boom 8 is rotatably supported in the front part of the upper turning body 12 via a boom pin. The arm 9 is rotatably coupled to the distal end of the boom 8 via an arm pin, and the bucket 10 is rotatably coupled to the distal end of the arm 9 via a bucket pin. The boom 8 is driven by a boom cylinder 5, the arm 9 is driven by an arm cylinder 6, and the bucket 10 is driven by a bucket cylinder 7.

A boom angle sensor 30, an arm angle sensor 31, and a bucket angle sensor 32 are attached to the boom pin, the arm pin, and a bucket link 13, respectively, so as to measure rotation angles α, β, γ (see FIG. 4A) of the boom 8, the arm 9, and the bucket 10. To the upper turning body 12, a machine body inclination angle sensor 33 that detects an inclination angle ϕ (see FIG. 4A) of the upper turning body 12 (the machine body 1B) relative to a reference plane (for example, a horizontal plane) is attached. Note that each of the angle sensors 30, 31, 32 may be replaced with an angle sensor relative to the reference plane (for example, the horizontal plane).

A turning angle sensor 34 is attached on a turning center axis (also referred to as a turning axis) so as to measure a relative angle θ (see FIG. 4A, FIG. 4B) between the upper turning body 12 and the lower traveling body 11.

In a driver's cab 120 provided on the upper turning body 12, a right traveling lever 23*a* for operating the right traveling hydraulic motor 3*a* (the lower traveling body 11), a left traveling lever 23*b* for operating the left traveling hydraulic motor 3*b* (the lower traveling body 11), a right operation lever 22*a* for operating the boom cylinder 5 (the boom 8) and the bucket cylinder 7 (the bucket 10), and a left operation lever 22*b* for operating the arm cylinder 6 (the arm 9) and the turning hydraulic motor 4 (the upper turning body 12) are disposed. Hereinafter, the right traveling lever 23*a*, the left traveling lever 23*b*, the right operation lever 22*a*, and the left operation lever 22*b* may collectively be referred to as operating devices 22, 23.

In addition, in the driver's cab 120, an engine speed setting device 480 for setting the engine speed is disposed.

As illustrated in FIG. 2, an engine 18 that is a prime mover mounted on the upper turning body 12 drives hydraulic pumps 2*a*, 2*b* and a pilot pump 48. The hydraulic pumps 2*a*, 2*b* are variable displacement pumps in which the displacement is controlled by regulators 2*aa*, 2*ba*. The pilot pump 48 is a fixed displacement pump. The hydraulic pump 2 and the pilot pump 48 suck hydraulic fluid from a tank 200. In the present embodiment, as illustrated in FIG. 2, a control signal output from a controller 40 is input to the regulators 2*aa*, 2*ba*. Although a detailed configuration of the regulators 2*aa*, 2*ba* will be omitted, a discharge flow rate of the hydraulic pumps 2*a*, 2*b* is controlled in accordance with the control signal.

A pump line 130, which is a discharge pipe of the pilot pump 48, first passes through a lock valve 39, and then is connected to each proportional solenoid valve in the solenoid valve unit 160. The lock valve 39 is a solenoid selector valve in this example, and a solenoid drive section thereof is electrically connected to a position detector of a gate lock lever (not illustrated) disposed in the driver's cab 120 (FIG. 1). The position of the gate lock lever is detected by the position detector, and a signal corresponding to the position of the gate lock lever is input from the position detector to the lock valve 39. When the position of the gate lock lever is in a lock position, the lock valve 39 closes to shut off the pump line 130. When the position of the gate lock lever is in an unlock position, the lock valve 39 opens to connect the pump line 130. That is, in a state where the pump line 130 is shut off, the operation by the operating devices 22, 23 is disabled, and the operation such as traveling, turning, excavation, or the like is prohibited.

The operating devices 22, 23 are of an electric lever system, and generate an electrical signal corresponding to the amount and direction of the operation by an operator. The electrical signal thus generated is input to the controller 40, and the controller 40 outputs the electrical signal to the solenoid valve unit 160 to drive the proportional solenoid valves 50 to 55 (see FIG. 3) corresponding to the operation input to the operating devices 22, 23. The proportional solenoid valves 50 to 55 receive the electrical signals, and the electrical signals are supplied to corresponding hydraulic drive sections 150*a* to 155*b* of flow rate control valves 15*a* to 15*f* via pilot lines 140*a* to 145*b* and used as control signals for driving these flow rate control valves 15*a* to 15*f*.

The pressure oil discharged from the hydraulic pump 2 is supplied to the right traveling hydraulic motor 3*a*, the left traveling hydraulic motor 3*b*, the turning hydraulic motor 4, the boom cylinder 5, the arm cylinder 6, and the bucket cylinder 7 via the flow rate control valves 15*a*, 15*b*, 15*c*, 15*d*, 15*e*, 15*f*. With the pressure oil supplied, the boom cylinder 5, the arm cylinder 6, and the bucket cylinder 7 extend and retract, whereby the boom 8, the arm 9, and the bucket 10 rotatably move, respectively, and the position and posture of the bucket 10 change. In addition, with the pressure oil supplied, the turning hydraulic motor 4 rotates, whereby the upper turning body 12 turns relative to the lower traveling body 11. In addition, with the pressure oil supplied, the right traveling hydraulic motor 3*a* and the left traveling hydraulic motor 3*b* rotate, whereby the lower traveling body 11 travels.

The turning hydraulic motor 4, the boom cylinder 5, the arm cylinder 6, and the bucket cylinder 7 are provided with pressure sensors 16*a* to 16*f*, 16*k* to 16*l* so as to detect actuator pressures thereof. The pressure sensors 16*a* to 16*f*, 16*k* to 16*l* detect pressures in the input/output lines of the turning hydraulic motor 4 and pressures on the bottom side and the rod side of each of the boom cylinder 5, the arm cylinder 6, and the bucket cylinder 7, and output the pressures as electrical signals to the controller 40 (in FIG. 2, connection lines from the pressure sensors 16*a* to 16*f*, 16*k* to 16*l* to the controller 40 are not illustrated due to spaces).

Passages in which the traveling hydraulic motors 3*a*, 3*b* are connected to the flow rate control valves 15*e*, 15*f* are provided with pressure sensors 16*g* to 16*j* so as to detect actuator pressures of the traveling hydraulic motors 3*a*, 3*b*. The pressure sensors 16*g* to 16*j* detect pressures in the input/output lines of the traveling hydraulic motors 3*a*, 3*b*, and output the pressures as electrical signals to the controller 40 (in FIG. 2, connection lines from the pressure sensors 16*g* to 16*j* to the controller 40 are not illustrated due to spaces).

The engine 18 is provided with an engine controller 470 that controls the speed of the engine 18 in accordance with a control signal from the controller 40. The engine 18 is provided with an engine speed detecting device 490 that is a rotation sensor for detecting the engine speed.

<Solenoid Valve Unit 160>

As illustrated in FIG. 3, the solenoid valve unit 160 includes proportional solenoid valves 50*a* to 55*b* that are connected, on a primary port side, to the pilot pump 48 via the pump line 130 and that output a pilot pressure from the pilot pump 48 to the pilot lines 140*a* to 145*b* while reducing the pilot pressure.

The pilot lines 140*a* to 145*b* are provided with pressure sensors 17*a* to 17*l* so as to detect output pressures of the proportional solenoid valves 50*a* to 55*b*.

The openings of the proportional solenoid valves 50*a* to 55*b* are minimum when no current is applied, and the openings increase as currents as the control signals from the controller 40 are increased. In this way, the openings of the proportional solenoid valves 50*a* to 55*b* correspond to the control signals from the controller 40.

The proportional solenoid valves 54*a*, 55*a* drive the traveling hydraulic motor 3 in a direction in which the lower traveling body 11 moves forward, and the proportional solenoid valves 54*b*, 55*b* drive the traveling hydraulic motor 3 in a direction in which the lower traveling body 11 moves backward.

In the solenoid valve unit 160 with the above-described configuration, when a control signal is output from the controller 40 to drive the proportional solenoid valves 50*a* to 55*b*, a pilot pressure can be generated even when there is no corresponding operation of the operating devices 22, 23 by the operator, and thus, the actions of the actuators (3 to 7) can be forcibly generated.

Figure 4A:
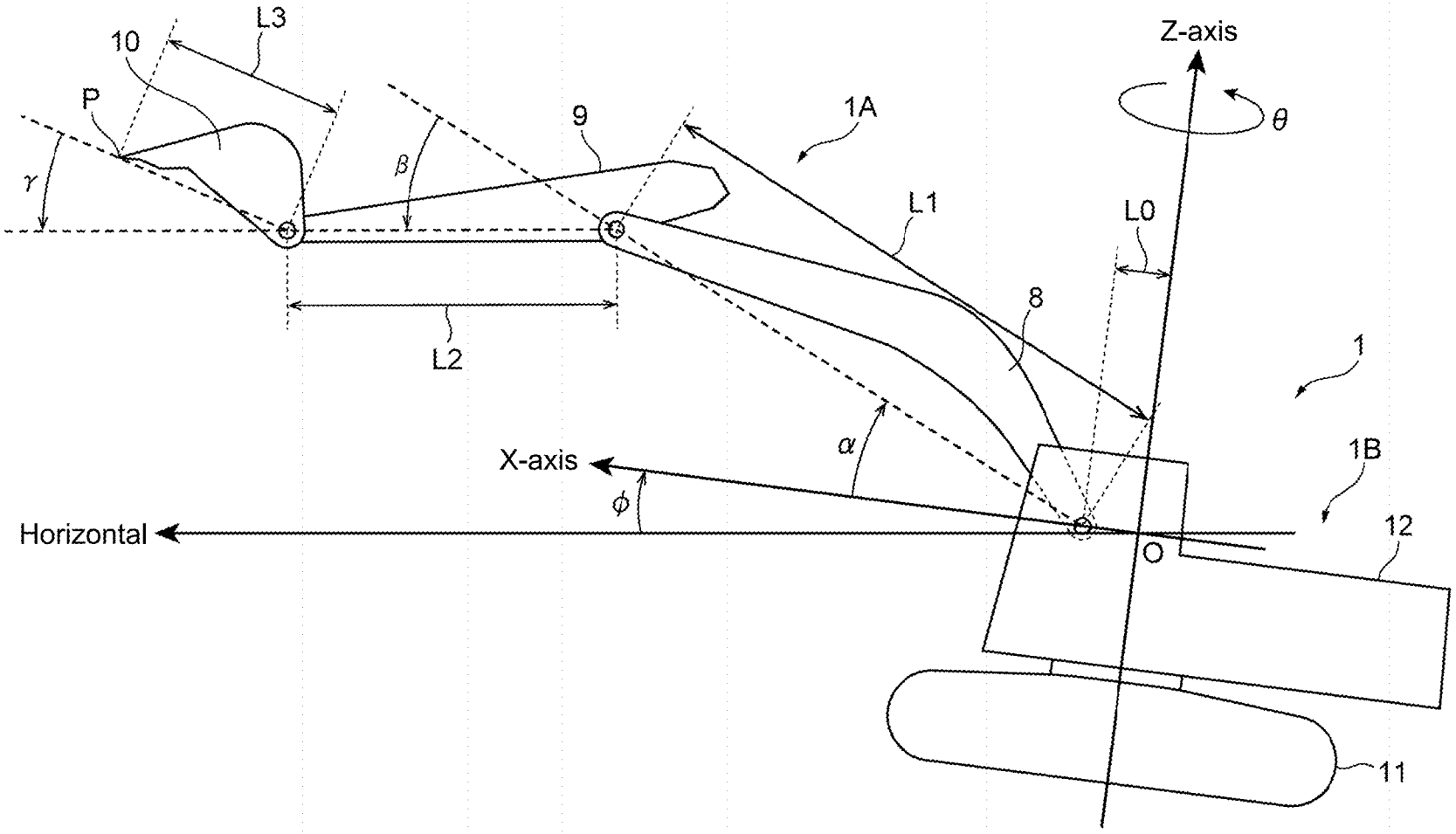
FIG. 4A is a side view illustrating a coordinate system of the hydraulic excavator of FIG. 1.
Figure 4B:
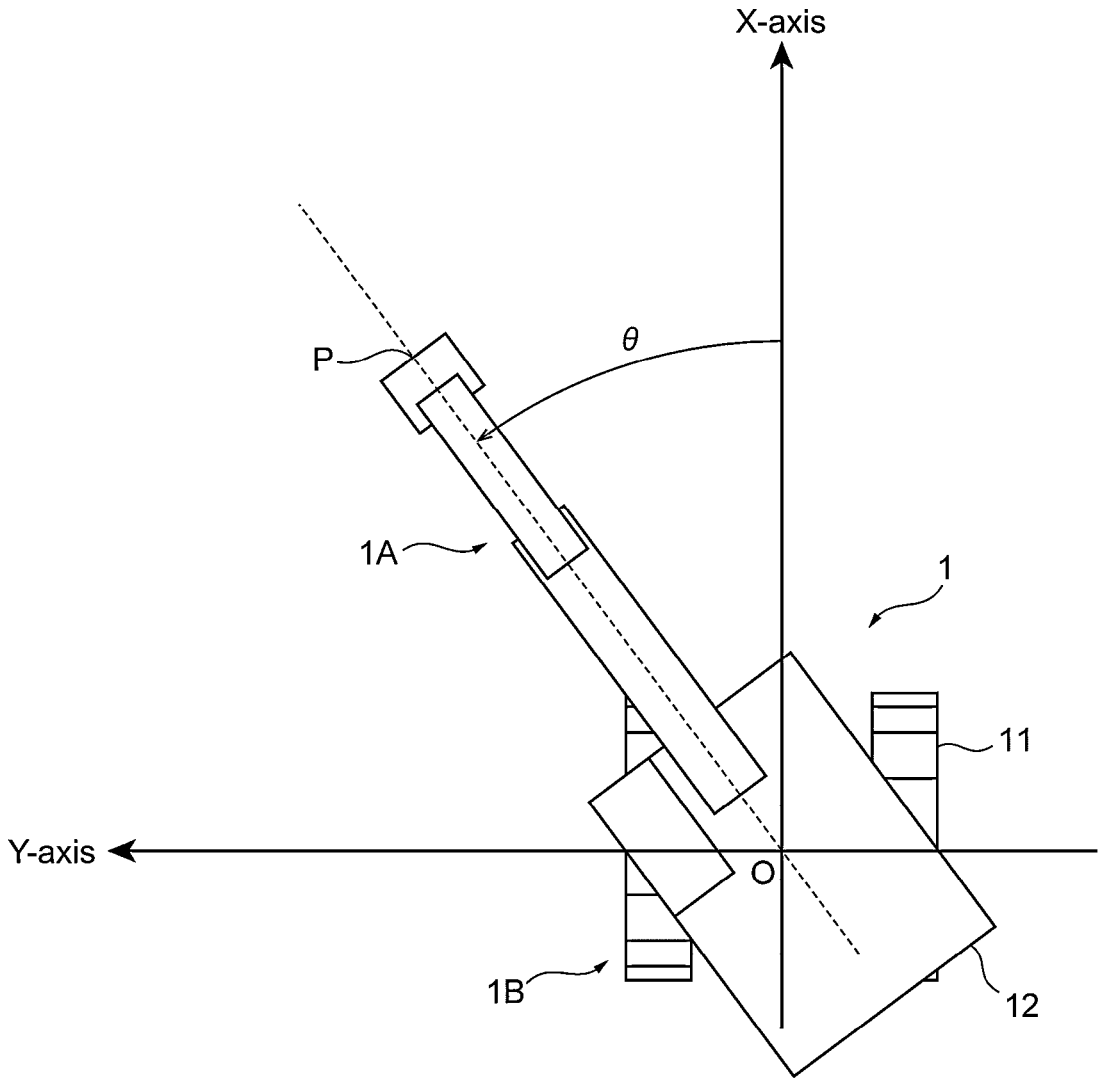
FIG. 4B is a top plan view illustrating the coordinate system of the hydraulic excavator of FIG. 1.

Here, a hydraulic excavator coordinate system set on the hydraulic excavator will be described. FIG. 4A and FIG. 4B are diagrams for explaining the excavator coordinate system, in which FIG. 4A is a side view, and FIG. 4B is a top plan view.

As illustrated in FIG. 4A and FIG. 4B, in the present embodiment, the excavator coordinate system is defined for the hydraulic excavator 1. The excavator coordinate system is a fixed XYZ coordinate system with respect to the lower traveling body 11, and sets a machine body coordinate system having a Z-axis that passes through the turning center point and is positively oriented upwards along the turning center axis of the upper turning body 12, an X-axis that passes through the proximal end of the boom perpendicularly to the Z-axis and is positively oriented frontwards along a plane where the front work device 1A operates in a posture in which the upper turning body 12 faces the front relative to the lower traveling body 11, and a Y-axis that passes through the intersection point between the Z-axis and the X-axis and is positively oriented towards the viewer of the paper surface of FIG. 4A so as to form a right-handed coordinate system.

In addition, the distance from the intersection point (origin O) between the X-axis and the Z-axis to the boom proximal end is denoted by L0, the length of the boom 8 (the direct distance between the coupling portions at its opposite ends) is denoted by L1, the length of the arm 9 (the direct distance between the coupling portions at its opposite ends) is denoted by L2, the length of the bucket 10 (the direct distance between the coupling portion to the arm and the bucket tip) is denoted by L3, the angle formed between the boom 8 and the XY-plane (the relative angle between a straight line in the lengthwise direction and the XY-plane) is defined by a rotation angle $\alpha$, the angle formed between the arm 9 and the boom 8 (the relative angle between straight lines in the lengthwise direction) is defined by a rotation angle $\beta$, the angle formed between the bucket 10 and the arm 9 (the relative angle between straight lines in the lengthwise direction) is defined by a rotation angle $\gamma$, and the angle formed between the lower traveling body 11 and the upper turning body 12 (the relative angle between the X-axis and the center line of the front device 1A in the overhead view of the XY-plane from the upper side of the Z-axis, see FIG. 4A) is defined by a rotation angle (the relative angle) $\theta$. As a result, the coordinates of the bucket tip position and the posture of the front work device 1A in the excavator coordinate system can be represented by L0, L1, L2, L3, $\alpha$, $\beta$, $\gamma$, and $\theta$.

Further, an inclination in the front-rear direction of the machine body 1B of the hydraulic excavator 1 relative to the horizontal plane is denoted by an angle (inclination angle) $\phi$ (see FIG. 4A).

Controller 40

Figure 5:
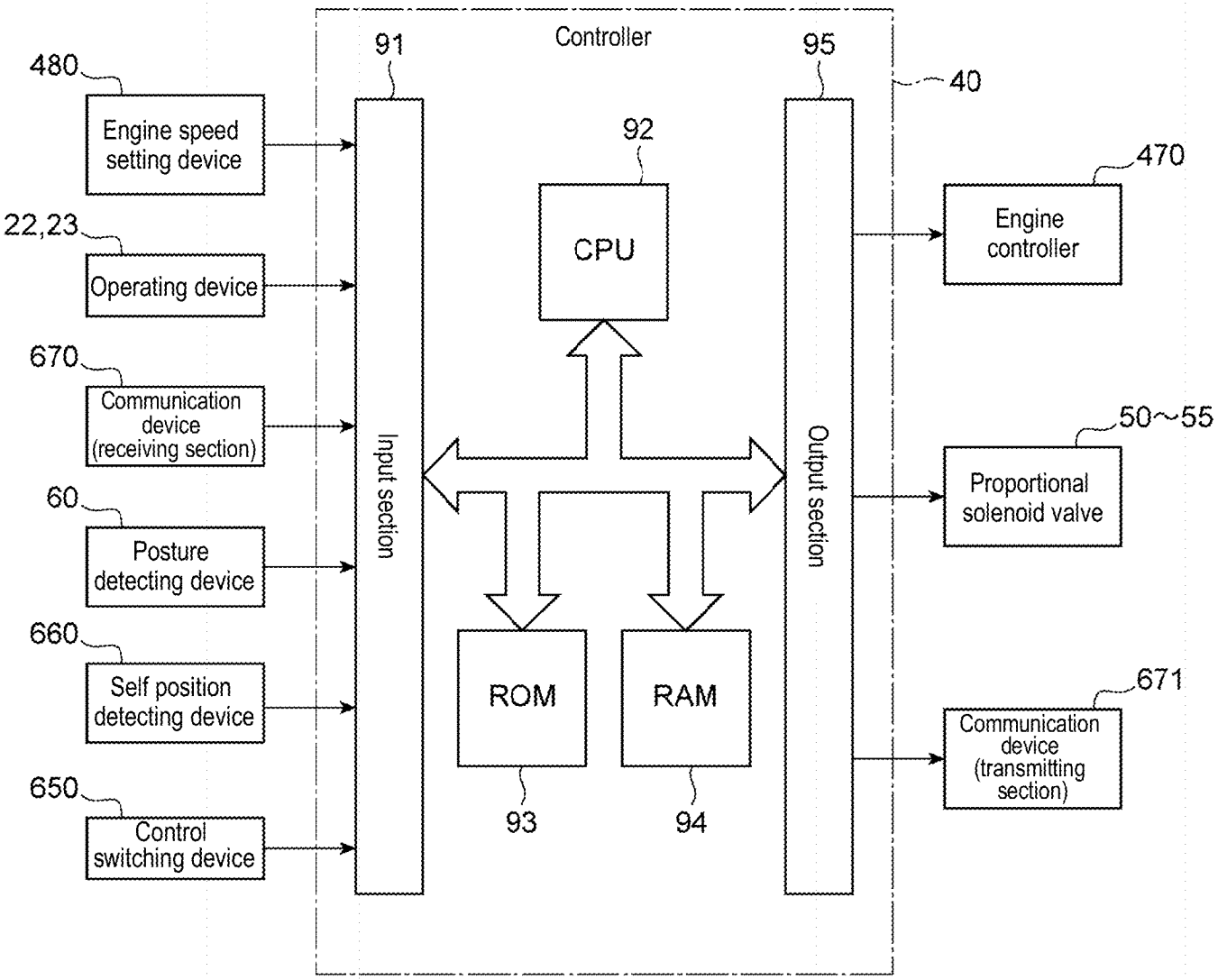
FIG. 5 is a hardware configuration diagram of the controller of a first embodiment.

FIG. 5 is a configuration diagram of the system of the hydraulic excavator according to the first embodiment of the present invention.

The system of FIG. 5 includes a posture detecting device 60, the operating devices 22, 23, the engine speed setting device 480 for setting the engine speed provided in the driver's cab 120, the controller (control device) 40 as a computer having control over the system, the engine controller 470 that controls the speed of the engine 18 or the like according to the control signal from the controller 40, and the proportional solenoid valves 50 to 55 that generate actions of the actuators (3 to 7) according to the control signals from the controller 40.

The posture detecting device 60 is made up of the boom angle sensor 30, the arm angle sensor 31, the bucket angle sensor 32, the machine body inclination angle sensor 33, and the turning angle sensor 34. These angle sensors 30, 31, 32, 34 and inclination angle sensor 33 function as a posture sensor that detects the posture of the front work device 1A.

The hydraulic excavator 1 includes a control switching device 650 that switches the operation state of the hydraulic excavator 1 between an onboard operation state and an automated control state. The control switching device 650 is disposed in the driver's cab 120, for example. When the onboard operation state is selected, the operating devices 22, 23 are operated by an operator onboard inside of the driver's cab 12 and the hydraulic excavator 1 operates on the basis of signals from these operating devices 22, 23, whereas when the automated control state is selected, the hydraulic excavator 1 operates on the basis of signals received at a communication device 670 (described later) without relying on the operation of the operating devices 22, 23 by the operator.

Furthermore, the automated control includes automated traveling control for automating traveling operation and automated work control (automated excavation control) for automating excavation work, which will be described later.

The hydraulic excavator 1 includes a self position detecting device 660 that detects a position and orientation of the hydraulic excavator 1. The self position detecting device 660 may be configured by, for example, a global navigation satellite system (GNSS), or may be configured to detect a self position using simultaneous localization and mapping (SLAM) with LiDAR or a stereo camera.

The hydraulic excavator 1 includes communication devices 670, 671 that communicate with an external system (in other words, communicatively connect the hydraulic excavator 1 and the external system). The communication devices 670, 671 may be disposed in the hydraulic excavator 1 or may be disposed outside of the hydraulic excavator 1. In addition, the communication device (receiving section) 670 and the communication device (transmitting section) 671 may be configured as a unitary component or may be configured as separate components. The communication device (receiving section) 670 receives signals related to the automated control of the hydraulic excavator 1 from the external system. The communication device (transmitting section) 671 transmits a state of the hydraulic excavator 1 (machine body information) to the external system.

In FIG. 5, the controller 40 includes an input section 91, a central processing unit (CPU) 92 that is a processor, a read only memory (ROM) 93 and a random access memory (RAM) 94 that are storage devices, and an output section 95. The input section 91 receives, as inputs, signals from the angle sensors 30 to 32, 34 and inclination angle sensor 33 that form the posture detecting device 60, signals indicating operation amounts from the operating devices 22, 23, a signal from the engine speed setting device 480, a signal from the control switching device 650, a signal from the self position detecting device 660, and signals from the communication device 670, and performs conversion into a form which can be computed by the CPU 92. The ROM 93 is a recording medium having stored therein a control program for executing control content including processing related to the flowchart (described later) and various kinds of information needed to execute the flowchart, and the like, and the CPU 92 performs predetermined computing processing on the signals taken in from the input section 91 and the memories (93, 94) according to the control program stored in the ROM 93. The output section 95 generates signals for output according to a computation result obtained by the CPU 92, and outputs the signals to the engine controller 470 and the proportional solenoid valves 50 to 55, thereby driving and controlling the engine 18 and the hydraulic actuators (3 to 7). The output section 95 transmits the computation result obtained by the CPU 92 to the communication device 671, thereby transmitting the state of the hydraulic excavator 1 to the outside (the external system) of the hydraulic excavator 1.

Note that the controller 40 of FIG. 5 includes a semiconductor memory such as the ROM 93 and the RAM 94 as the storage device. However, the controller 40 may be replaced with a controller having any storage device; for example, the controller 40 may include a magnetic storage device such as a hard disk drive.

Figure 6:
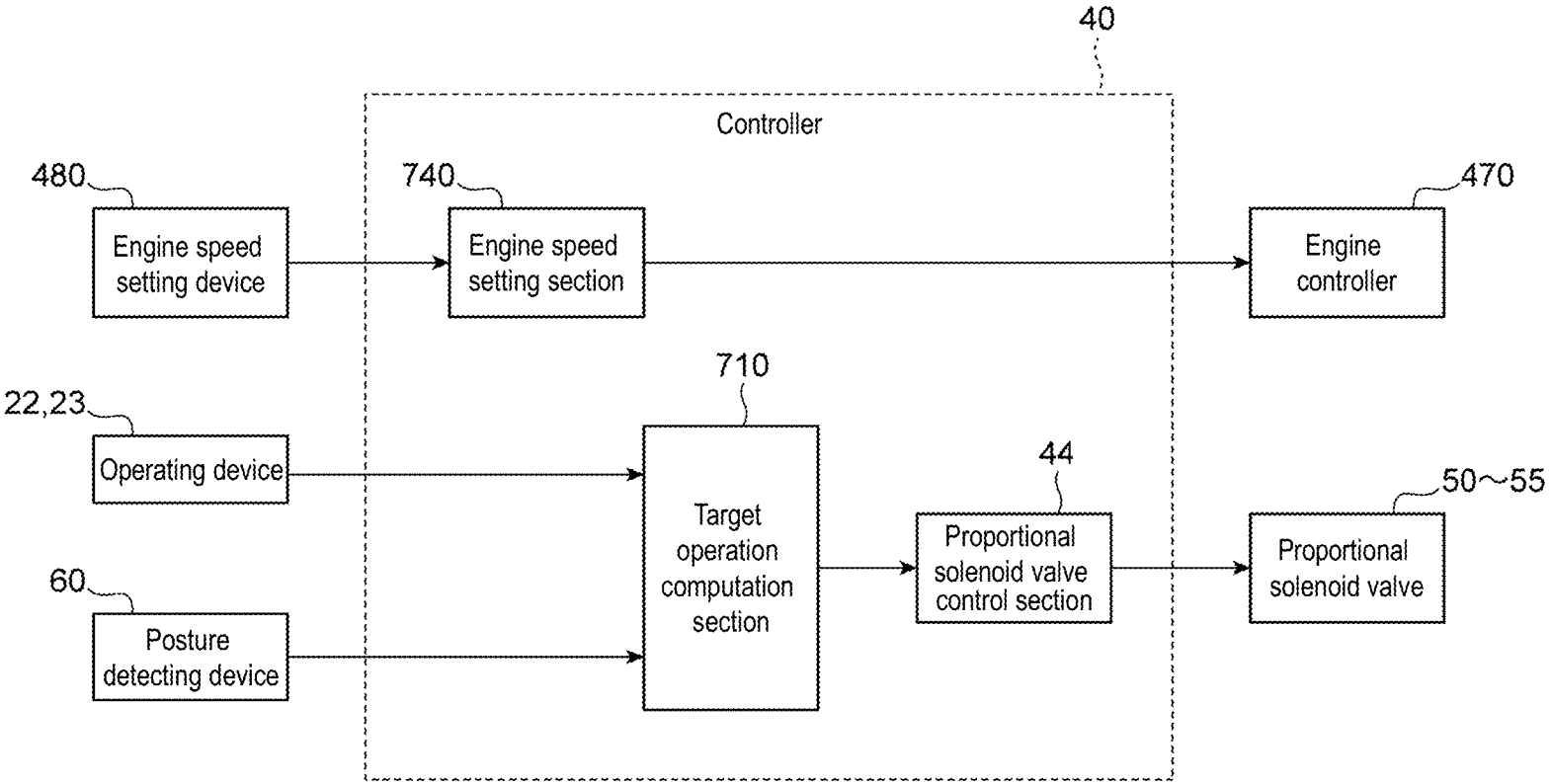
FIG. 6 is a functional block diagram of the controller of the first embodiment (during onboard operation).
Figure 7:
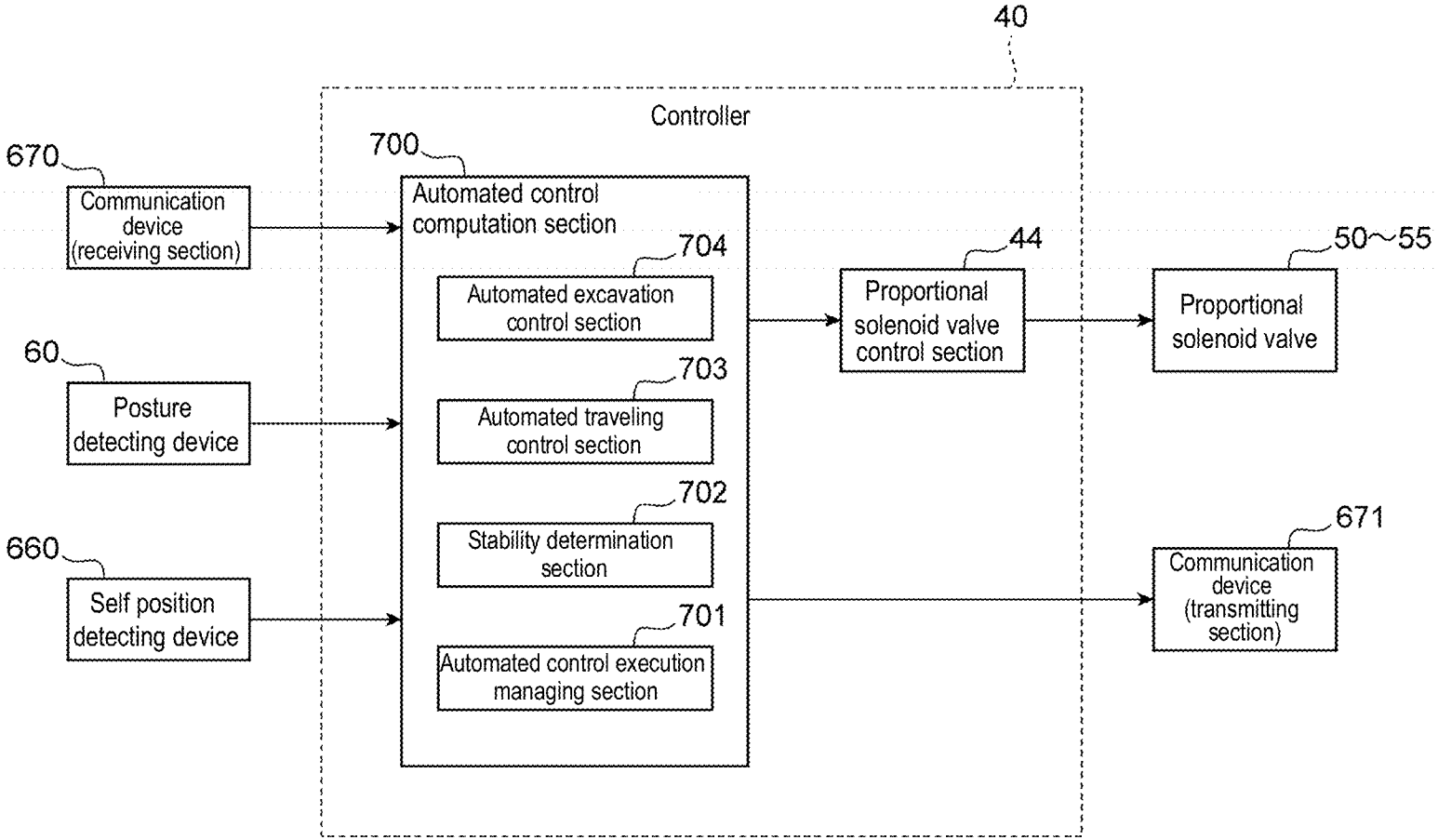
FIG. 7 is a functional block diagram of the controller of the first embodiment (during automated control).

FIG. 6 and FIG. 7 are functional block diagrams of the controller 40. FIG. 6 illustrates a functional block diagram executed when the control switching device 650 is in the onboard operation state (during manual operation performed by the operator onboard), and FIG. 7 illustrates a functional block diagram executed when the control switching device 650 is in the automated control state (during automated driving that does not rely on the operation by the operator).

The controller 40 includes a proportional solenoid valve control section 44, an automated control computation section 700, a target operation computation section 710, and an engine speed setting section 740.

The engine speed setting section 740 (FIG. 6) sets a target engine speed on the basis of a signal from the engine speed setting device 480, and outputs the signal corresponding to the set target engine speed to the engine controller 470.

Figure 8:
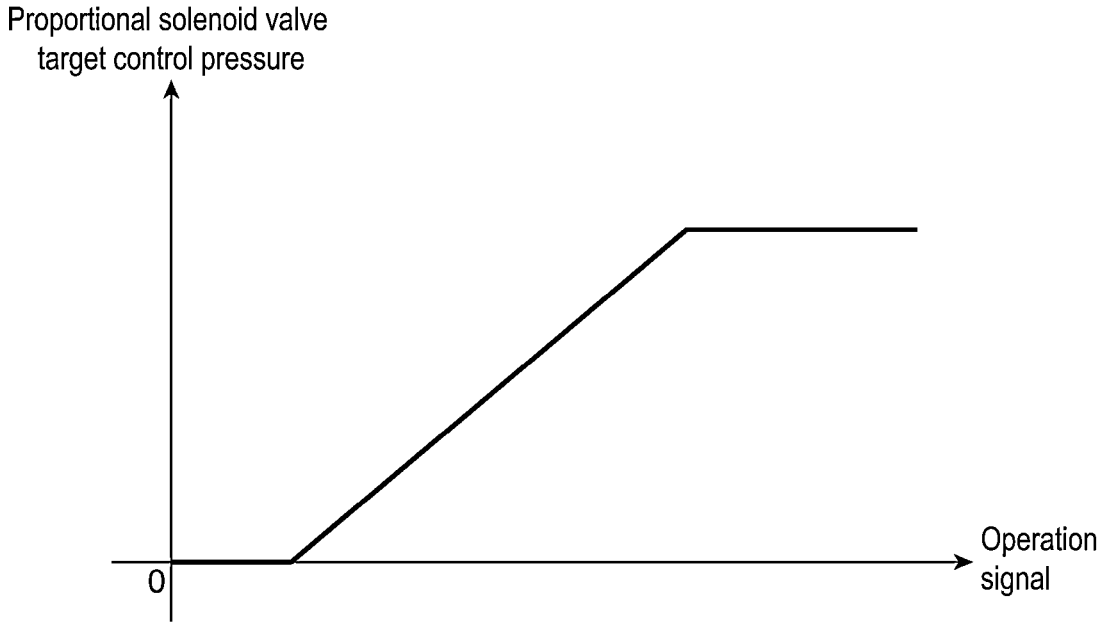
FIG. 8 is a graph illustrating a relationship between a target control pressure of a proportional solenoid valve and an operation signal.

The target operation computation section 710 (FIG. 6) computes target control pressures of the proportional solenoid valves 50 to 55 corresponding to the operations of the operating devices 22, 23 on the basis of operation signals from the operating devices 22, 23 and signals from the posture detecting device 60, and outputs the computed target control pressures. As specific computation content, a target control pressure of the proportional solenoid valve corresponding to the operation signal is set in advance as a table as illustrated in FIG. 8, and in accordance with this, a target control pressure of each of the proportional solenoid valves 50 to 55 is output.

The automated control computation section 700 (FIG. 7) executes various kinds of computation for executing automated control on the basis of the signals received from the communication device 670, the signals from the posture detecting device 60, and the signal from the self position detecting device 660, and outputs the computation result (target control pressures of the proportional solenoid valves 50 to 55, the state of the hydraulic excavator 1, and the like).

The automated control computation section 700 includes an automated control execution managing section 701, a stability determination section 702, an automated traveling control section 703, and an automated excavation control section (automated work control section) 704.

The automated control execution managing section 701 manages control of which of the stability determination section 702, the automated traveling control section 703, and the automated excavation control section 704 is to be executed. This will be described in detail later referring to the control flowchart.

The stability determination section 702 determines whether the ground is stable (stability of the ground) when automated control (for example, the automated excavation control 704) to be executed later is executed. This will be described in detail later referring to the control flowchart.

The automated traveling control section 703 calculates target control pressures of the proportional solenoid valves 54, 55 for performing automated traveling to the target position on the basis of a target position received from the communication device 670 and a signal from the self position detecting device 660. Specifically, in one exemplary configuration, first, the right traveling hydraulic motor 3*a* and the left traveling hydraulic motor 3*b* are operated in different directions such that a current orientation of the lower traveling body 11 conforms to a direction to the target position, and, after the orientation of the lower traveling body 11 matches the direction to the target position, the traveling hydraulic motors 3*a*, 3*b* are operated in the forward direction, so as to perform traveling to the target position.

The automated excavation control section (automated work control section) 704 calculates target control pressures of the proportional solenoid valves 50 to 53 for performing automated excavation on the basis of a target position received from the communication device 670 and a signal from the posture detecting device 60. Specifically, in one example, using the result obtained by the posture detecting device 60, the automated excavation control section (automated work control section) 704 calculates a bucket end (bucket tip) position P (see FIG. 4A and FIG. 4B) and calculates a direction toward the target position. Thereafter, the automated excavation control section (automated work control section) 704 computes how the actuators of the hydraulic excavator 1 may desirably be operated so that they are operated in the direction toward the target position, calculates target control pressures of the proportional solenoid valves 50 to 53 to achieve the computation result, and operates the hydraulic excavator 1.

The proportional solenoid valve control section 44 (FIG. 6 and FIG. 7) outputs control command values of the corresponding proportional solenoid valves 50 to 55 in accordance with the target control pressures output from the target operation computation section 710 or the automated control computation section 700 (or the automated traveling control section 703 or automated excavation control section 704 thereof).

<Control Flowchart>

Figure 9:
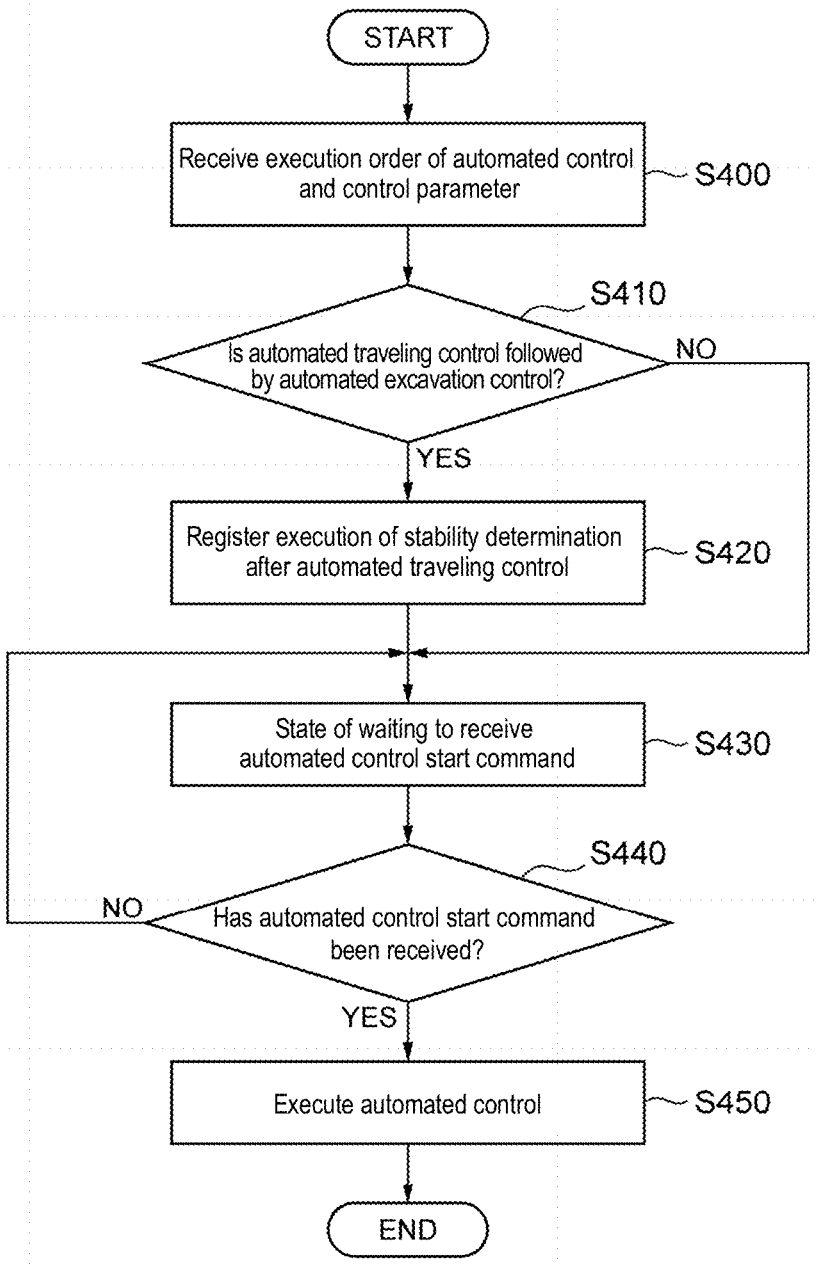
FIG. 9 is a control flowchart of an automated control execution managing section 701 of the first embodiment.
Figure 10:
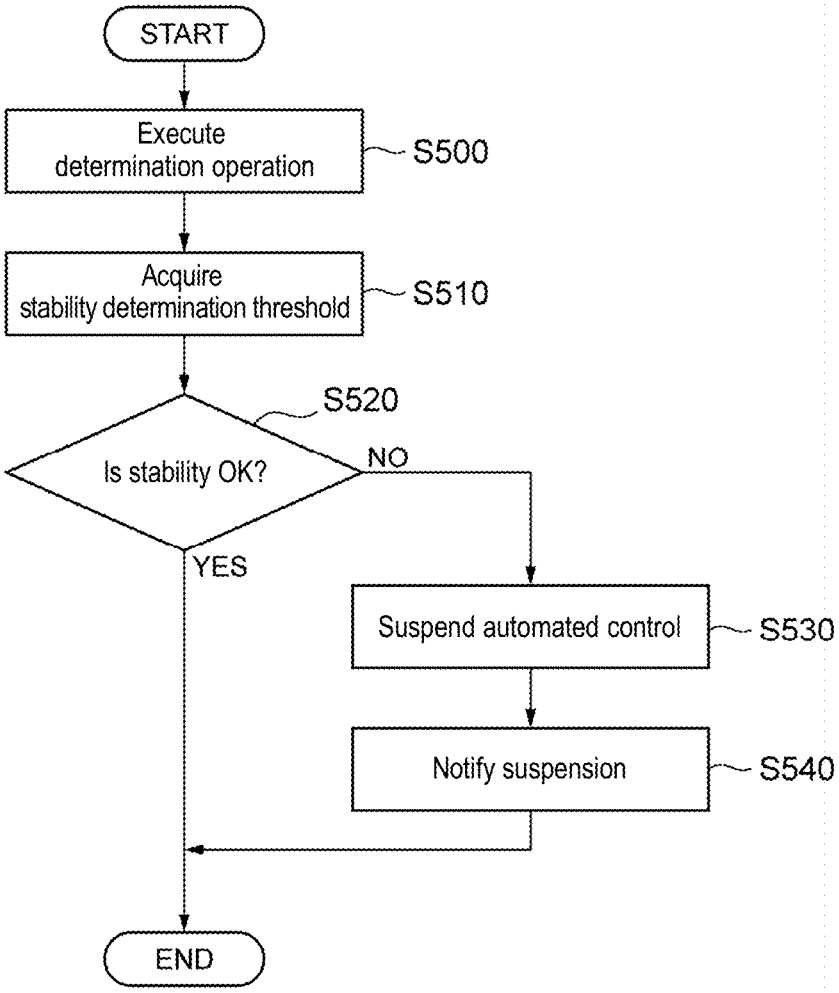
FIG. 10 is a control flowchart of a stability determination section 702 of the first embodiment.

FIG. 9 and FIG. 10 are control flowcharts of the automated control execution managing section 701 and the stability determination section 702 according to the first embodiment, respectively.

The control flowchart of the automated control execution managing section 701 of FIG. 9 will be described.

In S400, the automated control execution managing section 701 receives, from the external system via the communication device 670, an execution order of automated control and a control parameter (see the upper table in FIG. 11 as a specific example).

In S410, referring to the received execution order of automated control, the automated control execution managing section 701 determines whether there is an area where automated traveling control is followed by automated excavation control. When there is an area where automated traveling control is followed by automated excavation control (when YES), control proceeds to S420, and when there is no area where automated traveling control is followed by automated excavation control (when NO), control proceeds to S430.

In S420, the automated control execution managing section 701 inserts stability determination (execution registration) between the automated traveling control and the automated excavation control (i.e., after the automated traveling control and before the automated excavation control) (see the lower table in FIG. 11 as a specific example).

In S430, the automated control execution managing section 701 fixes the execution order of automated control and the control parameter, transmits them to the external system via the communication device 671, and enters a state of waiting to receive an automated control start command from the external system.

In S440, the automated control execution managing section 701 confirms, at a constant cycle, whether an automated control start command has been received from the external system via the communication device 670. When an automated control start command has been received (when YES), control proceeds to S450, and when no automated control start command has been received (when NO), control goes back to S430.

In S450, the automated control (the stability determination section 702, the automated traveling control section 703, and the automated excavation control section 704) is executed in accordance with the execution order fixed in S430. In the execution order of automated control received from the external system in S400, when there is an area where automated traveling control is followed by automated excavation control, the stability determination section 702 will be executed after the automated traveling control section 703 is executed and before the automated excavation control section 704 is executed.

The control flowchart of the stability determination section 702 of FIG. 10 will be described.

In S500, the stability determination section 702 executes a determination operation for evaluating stability. The determination operation is an operation set in advance, and includes, for example, an operation of raising/lowering the boom 8 in a predetermined posture, an operation of rotating the upper turning body 12 at one full turn in a predetermined posture, and the like. During this (i.e., while the preset operation for the stability determination is performed), the stability determination section 702 measures data (machine body information) to be used for the determination. Specifically, the stability determination section 702 measures an inclination angle $\phi$ of the upper turning body 12 (the machine body 1B), for example.

In S510, the stability determination section 702 acquires a stability determination threshold according to the content of automated control that will be executed after the stability determination. The stability determination threshold is set in advance for each content of automated control that will be executed after the stability determination is executed. For example, when performing automated control that requires precision, a small (strict) value is set for the threshold, and when performing automated control that does not require precision, a large (indulgent) value is set for the threshold.

In S520, the stability determination section 702 determines whether the stability is within an acceptable range on the basis of the data acquired in S500 and the stability determination threshold set in S510. When the stability determination section 702 determines that the stability is acceptable, that is, when the data acquired in S500 is within the stability determination threshold set in S510 (when YES), the process ends. When the stability determination section 702 determines that the stability is not acceptable, that is, when the data acquired in S500 exceeds the stability determination threshold set in S510 (when NO), control proceeds to S530.

In S530, the processing that was planned to be executed after the stability determination (in this example, automated control of the automated excavation control) is suspended, and control proceeds to S540.

In S540, the suspension of the processing (in this example, automated control of the automated excavation control) is transmitted to the external system via the communication device 671.

<Operation and Effects>

Figure 12:
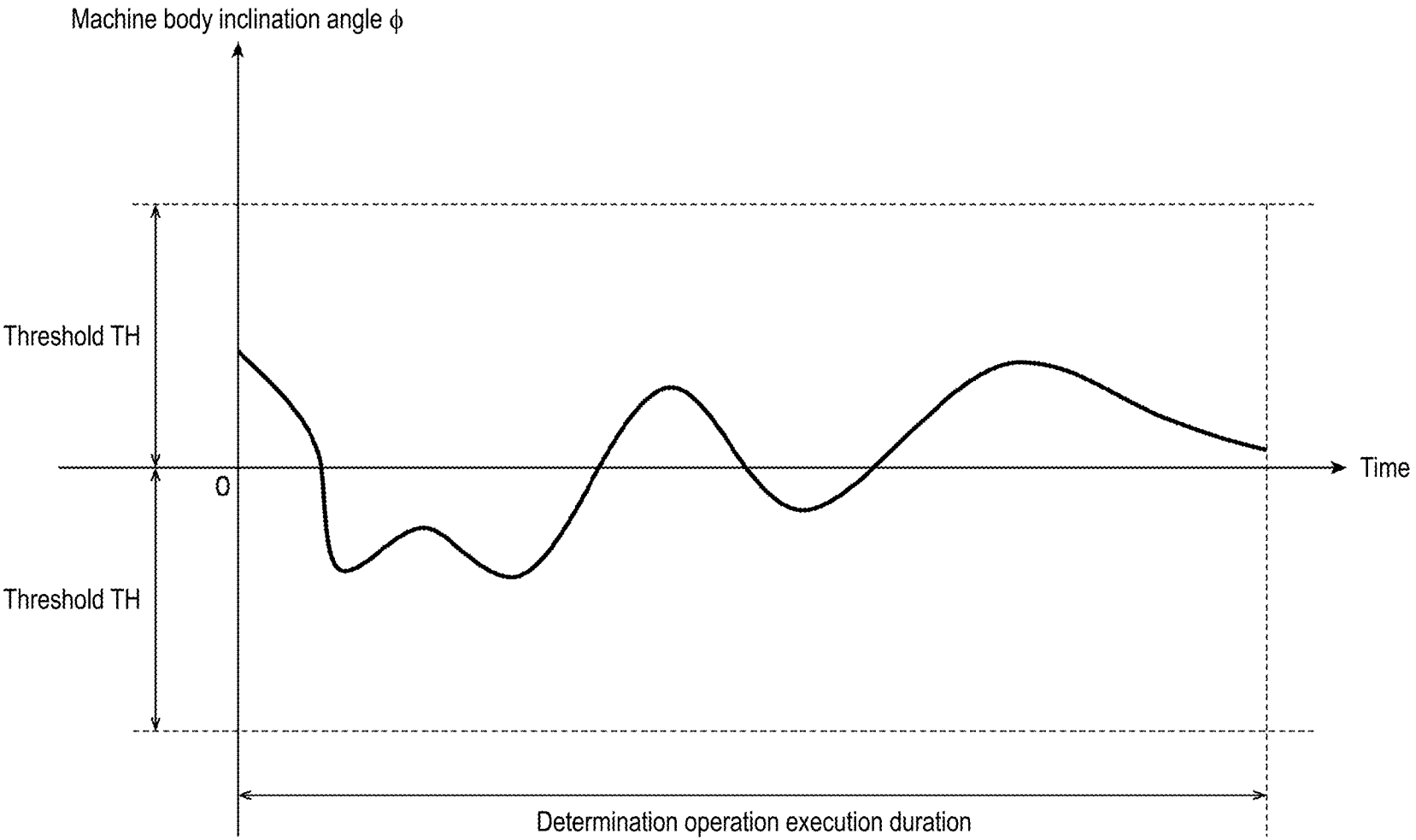
FIG. 12 is a graph illustrating a measurement result example 1 of a machine body inclination angle $\phi$ when S500 is executed in the first embodiment.
Figure 13:
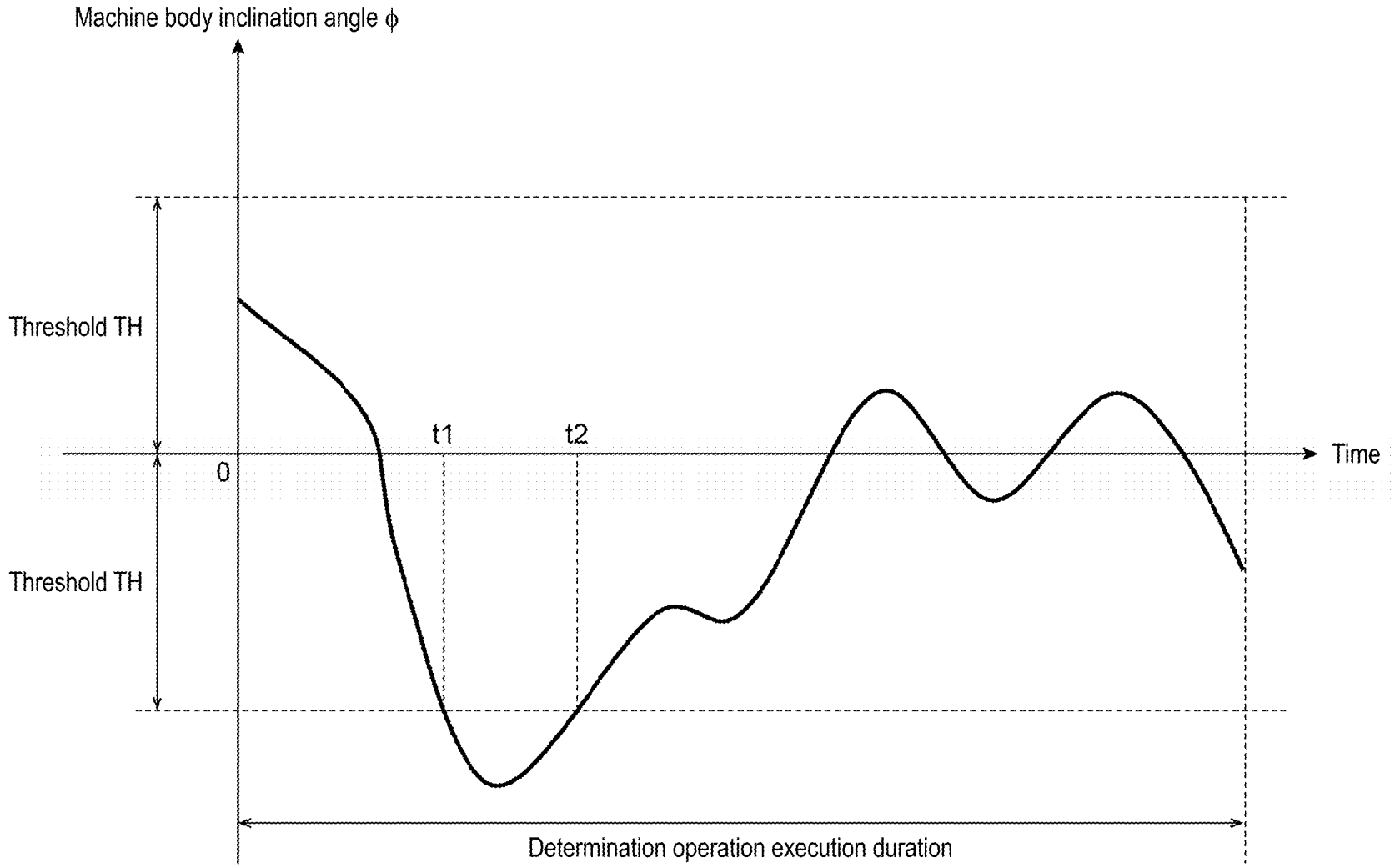
FIG. 13 is a graph illustrating a measurement result example 2 of a machine body inclination angle $\phi$ when S500 is executed in the first embodiment.

The following describes an operation example of the first embodiment referring to FIG. 11 to FIG. 13.

The upper table in FIG. 11 illustrates an example of the content transmitted by the external system to the hydraulic excavator 1. In this operation example, the external system sends a command to the hydraulic excavator 1 to perform automated traveling to a point (Tx1, Ty1), to perform automated traveling to a point (Tx2, Ty2), thereafter, to perform automated excavation control so as to pass through a point (Dx1, Dy1, Dz1) to a point (Dx3, Dy3, Dz3).

In S400, the automated control execution managing section 701 receives the command of the upper table in FIG. 11 from the external system.

In S410, since the upper table in FIG. 11 includes No. 2 automated traveling followed by No. 3 automated excavation, control proceeds to S420, and the automated control execution managing section 701 inserts stability determination (execution registration) into No. 3 as illustrated in the lower table in FIG. 11, and in S430, the automated control execution managing section 701 enters a state of waiting to receive an automated control start command from the external system.

When an automated control start command is sent from the external system, the determination in S440 is YES, and in S450, the automated control is executed in the order from No. 1 to No. 6 in the lower table in FIG. 11.

In No. 1 to No. 2, the automated traveling control (the automated traveling control section 703) toward the respective target positions is executed.

In No. 3, stability determination (the stability determination section 702) is conducted.

The following describes an operation example of the stability determination.

In S500, the stability determination section 702 executes a determination operation, and measures an inclination angle $\phi$ of the upper turning body 12 (the machine body 1B) during the execution.

In S510, the stability determination section 702 acquires a stability determination threshold. Herein, the stability determination section 702 acquires a threshold TH.

(1) When the measurement result in S500 is as illustrated in FIG. 12

As illustrated in FIG. 12, throughout the entire execution duration of determination operation, the magnitude of the inclination angle $\phi$ of the upper turning body 12 is equal to or smaller than the threshold TH. Thus, in S520, the stability is determined to be "stable," and processing in No. 3 stability determination (the stability determination section 702) ends.

Thereafter (that is, subsequent to No. 3 stability determination), No. 4 to No. 6 automated excavation control (the automated excavation control section 704) is executed.

(2) When the measurement result in S500 is as illustrated in FIG. 13

As illustrated in FIG. 13, in a section from t1 to t2 in the determination operation execution duration, the magnitude of the inclination angle $\phi$ of the upper turning body 12 exceeds the threshold TH. Thus, in S520, the stability is determined to be "not stable," and control proceeds to S530.

In S530, execution of No. 4 to No. 6 automated excavation control (the automated excavation control section 704) that was planned to be executed (after No. 3 stability determination) is suspended, and in S540, the suspension of the execution of No. 4 to No. 6 automated excavation control (the automated excavation control section 704) is notified to the external system via the communication device 671.

As described above, the automated control system of the hydraulic excavator (work machine) 1 of the present embodiment includes a work machine including a plurality of driven members that is driven by a plurality of actuators (3 to 7), and a control device that controls the work machine. The control device includes the automated traveling control section 703 that performs automated traveling of the work machine, the automated work control section (the automated excavation control section 704) that performs automated work of the work machine, and the stability determination section 702 that determines stability of ground for the work machine. When execution of the automated traveling control by the automated traveling control section 703 is to be followed by execution of automated work control by the automated work control section (the automated excavation control section 704), the control device executes stability determination by the stability determination section 702 before executing the automated work control, and executes automated control of the work machine (by at least one of the automated work control section (the automated excavation control section 704) or the automated traveling control section 703) on the basis of a determination result obtained by the stability determination section 702.

In addition, in the execution order of automated control of the work machine, when automated traveling control is to be followed by automated work control, the control device executes stability determination by the stability determination section 702 after the automated traveling control and before the automated work control, whereby the control device executes stability determination by the stability determination section 702 after executing the automated traveling control by the automated traveling control section 703 and before executing the automated work control by the automated work control section (the automated excavation control section 704).

In addition, the stability determination section 702 determines the stability on the basis of (dynamic) machine body information (for example, the inclination angle $\phi$) acquired through the preset determination operation performed by the work machine.

In addition, the stability determination section 702 determines the stability on the basis of an inclination angle $\phi$ of the work machine measured by a measuring device (the machine body inclination angle sensor 33) that measures an inclination angle $\phi$ of the work machine through the preset determination operation performed by the work machine (for example, while the work machine is performing the preset determination operation).

In addition, when the stability determined by the stability determination section 702 is "not stable," the automated control (that was planned to be executed after the stability determination) is suspended, and the suspension is notified to the external system via the communication device 671 that communicates with the external system.

In the automated control system of the hydraulic excavator 1 with the above-described configuration, it is possible to reduce workability loss due to the automated control inadvertently started on an unstable ground.

Second Embodiment

The second embodiment will be described referring to FIG. 14 to FIG. 17.

Figure 14:
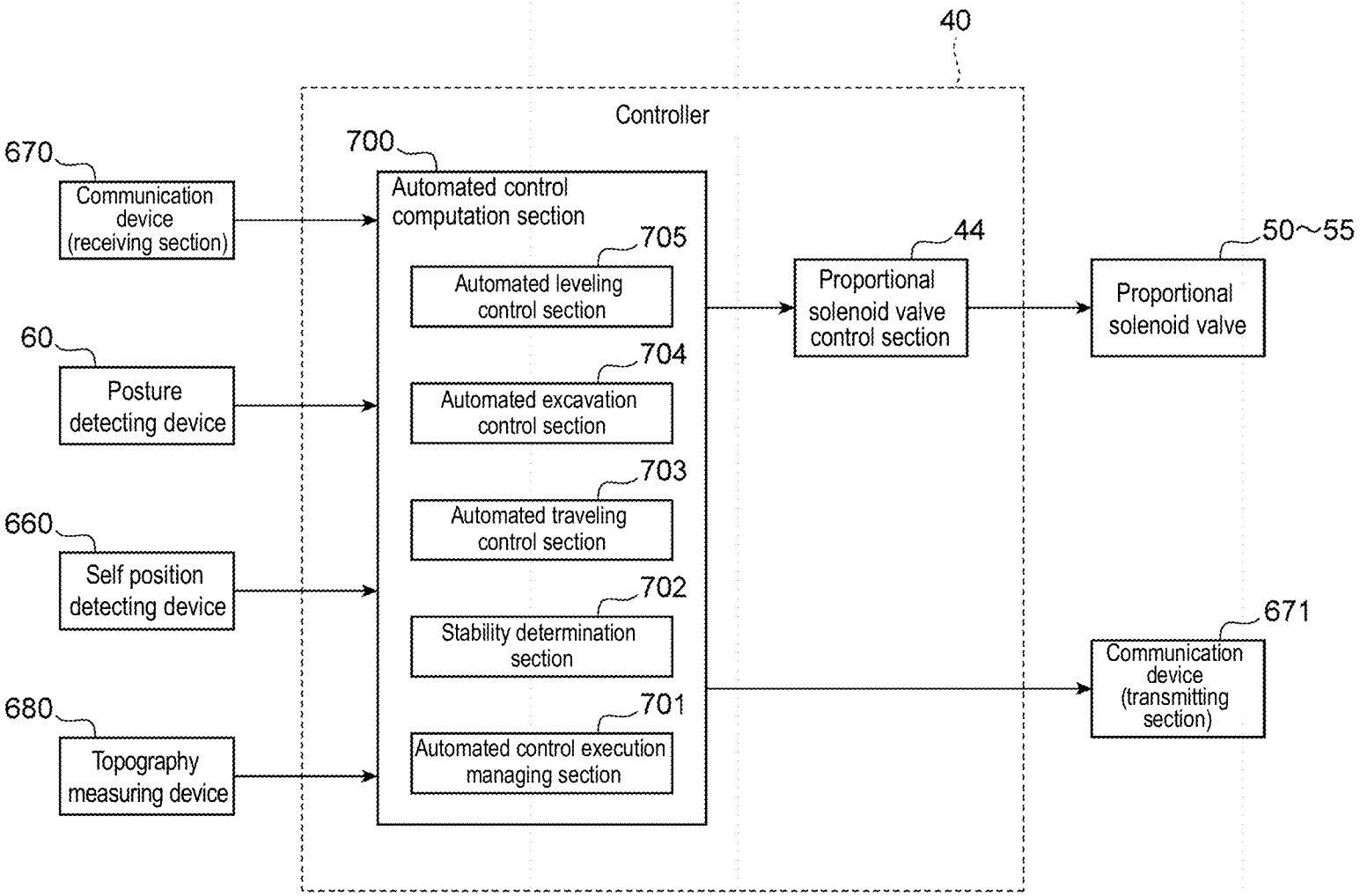
FIG. 14 is a functional block diagram of a controller of a second embodiment (during automated control).

FIG. 14 is a functional block diagram of the controller 40. FIG. 14 illustrates a functional block diagram executed when the control switching device 650 is in the automated control state (during automated driving that does not rely on the operation by the operator).

As illustrated in FIG. 14, the second embodiment is different from the first embodiment in that a topography measuring device 680 is provided.

The topography measuring device 680 measures a topography of the surrounding (i.e., in the vicinity) of the hydraulic excavator 1 and outputs measurement data to the automated control computation section 700 of the controller 40. The topography measuring device 680 is configured by LiDAR, a stereo camera, a millimeter wave radar, an ultrasonic sensor, or the like. The topography measuring device 680 may be disposed in the hydraulic excavator 1, or may be disposed outside of the hydraulic excavator 1 so as to be able to measure the surrounding of the hydraulic excavator 1.

In addition, the automated control computation section 700 includes an automated leveling control section 705.

The automated leveling control section 705 performs an operation of leveling the ground surface of the surrounding of the hydraulic excavator 1 using the bucket 10, and is configured to output target control pressures of the proportional solenoid valves 50 to 55 so as to perform a leveling operation that is programmed in advance, for example.

In the second embodiment, as a technique of stability evaluation, the stability determination is performed using a result of topography measurement obtained by the topography measuring device 680. In the second embodiment, unlike the first embodiment, before reaching a final target position (also referred to as a final position reached) in automated traveling, a topography in the vicinity of the final position reached is measured using the topography measuring device 680. Thus, in the automated control execution managing section 701 of the second embodiment, in S420 of FIG. 9, upon reaching a position (Tx2', Ty2'), which is apart from (before reaching) the target position in the automated traveling control by a predetermined distance Ls set in advance, the stability determination section 702 is executed to perform topography measurement using the topography measuring device 680 (see FIG. 16).

Figure 15:
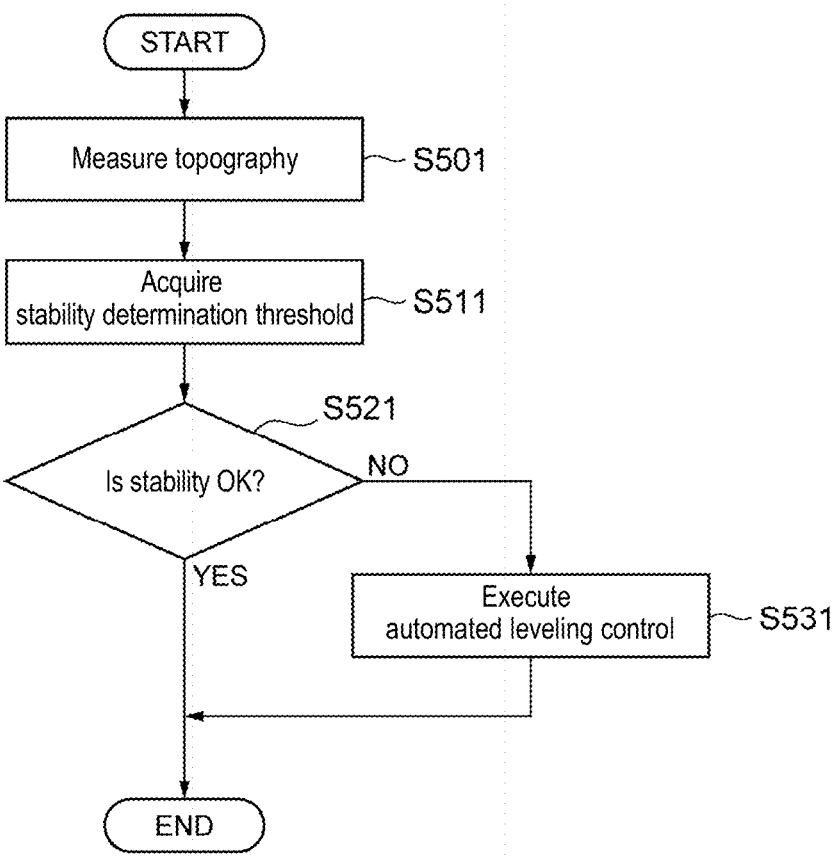
FIG. 15 is a control flowchart of a stability determination section 702 of the second embodiment.

The following describes details of the stability determination section 702 of the second embodiment referring to the control flowchart of FIG. 15.

In S501, the stability determination section 702 measures a topography on and in the vicinity of the final target position in automated traveling using the topography measuring device 680.

In S511, like the first embodiment, the stability determination section 702 acquires a stability determination threshold TH.

In S521, as a result of topography measurement, the stability determination section 702 determines whether a distance in the height direction from a reference value is equal to or smaller than the threshold TH. As a result of topography measurement, when the distance in the height direction from the reference value is equal to or smaller than the threshold TH, that is, when the stability is acceptable (when YES), the process ends. As a result of topography measurement, when the distance in the height direction from the reference value exceeds the threshold TH, that is, when the stability is not acceptable (when NO), control proceeds to S531.

In S531, automated leveling control by the automated leveling control section 705 is executed. Through this, the ground surface on and in the vicinity of the final target position in automated traveling is leveled.

<Operation and Effects>

Figure 16:
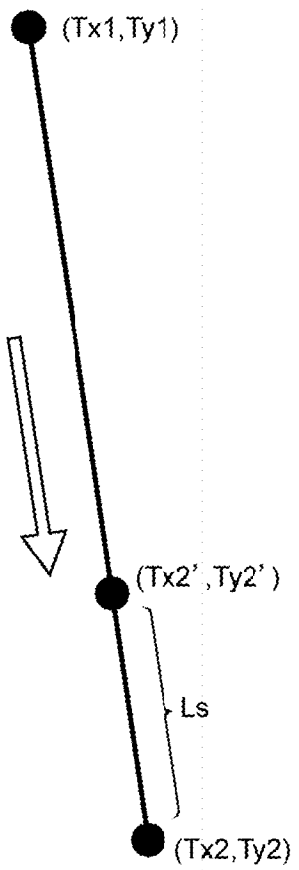
FIG. 16 is a diagram illustrating an operation example of the second embodiment.
Figure 17:
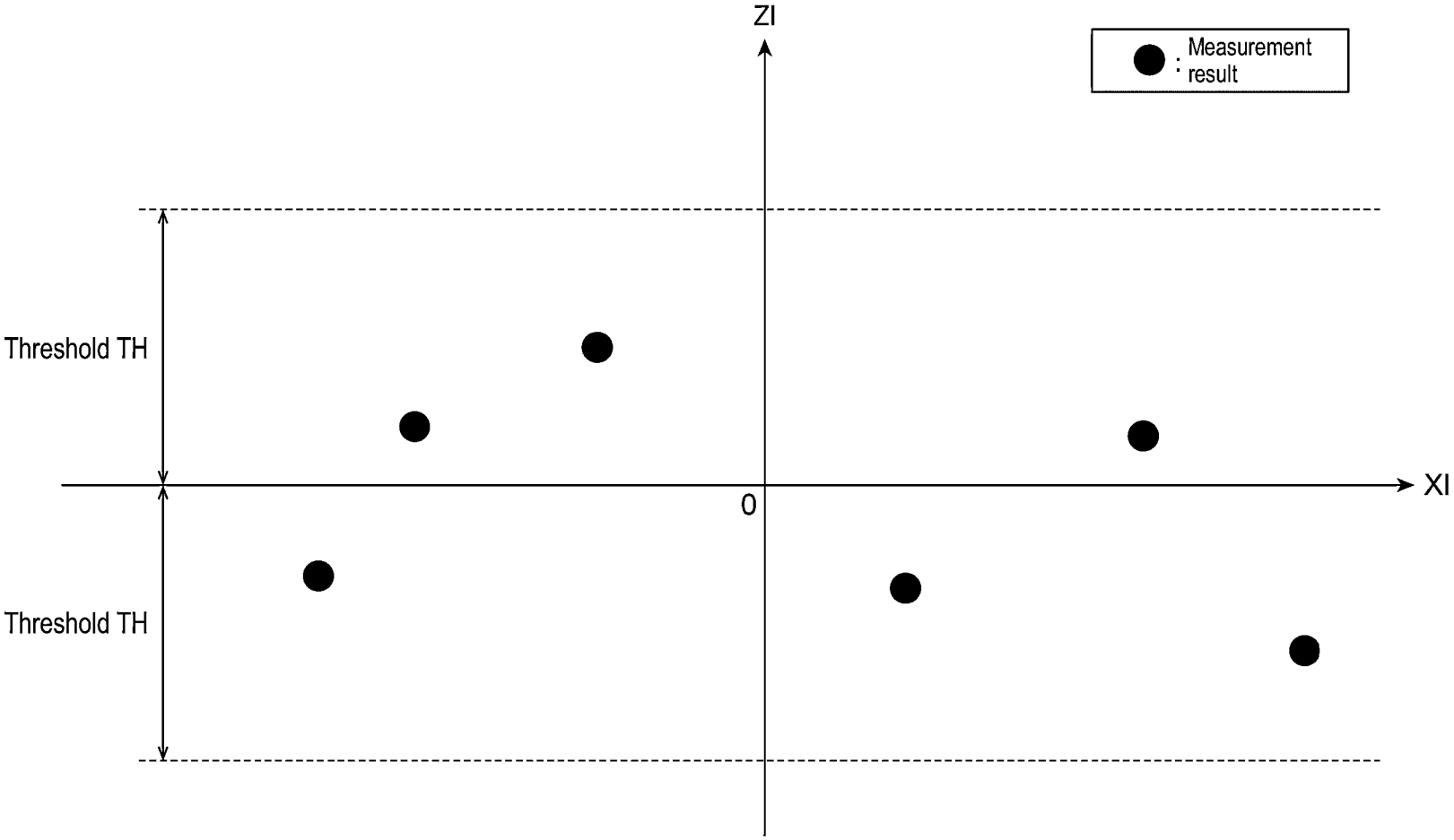
FIG. 17 is a graph illustrating a measurement result example of Z1 when S501 is executed in the second embodiment.
Figure 18:
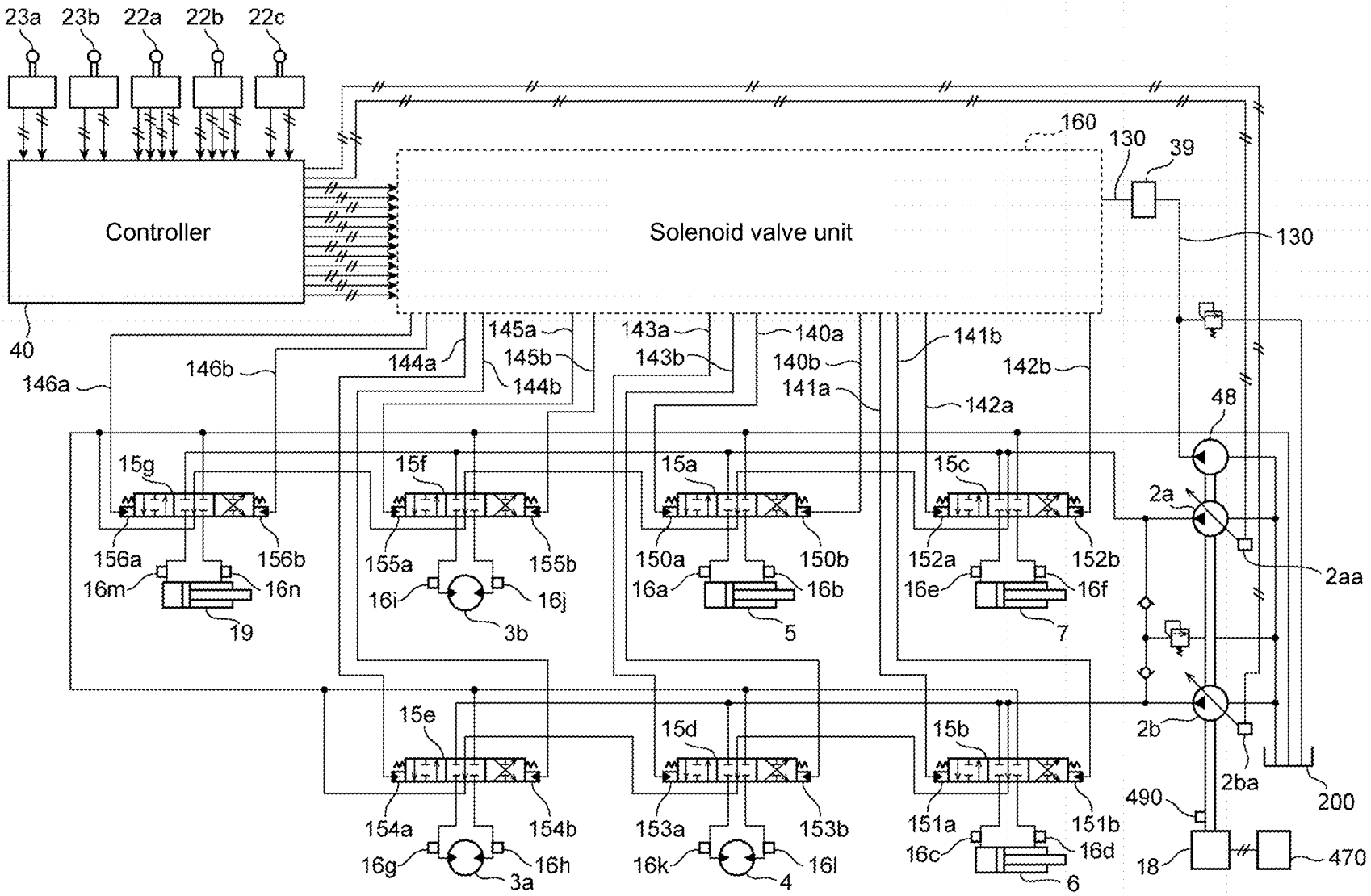
FIG. 18 is a diagram illustrating a controller of a hydraulic excavator of a third embodiment, together with a hydraulic drive device.

The following describes an operation example of the second embodiment referring to FIG. 16 and FIG. 17.

Like the first embodiment, the automated control execution managing section 701 receives the command of the upper table in FIG. 11 from the external system.

Like the first embodiment, the automated control execution managing section 701 makes an automated control execution plan as in the right table in FIG. 16. In the second embodiment, unlike the first embodiment, the automated control execution managing section 701 inserts stability determination (execution registration) into No. 3 so that No. 2 automated traveling is paused on a point (Tx2', Ty2') so as to execute the stability determination, and executes the automated traveling so as to travel the remaining distance (Ls) in No. 4.

When an automated control start command is sent from the external system, No. 1 to No. 2 automated traveling control (the automated traveling control section 703) toward the respective target positions is executed first, and then No. 3 stability determination (the stability determination section 702) is executed.

In S501, the stability determination section 702 measures a topography on and in the vicinity of a traveling target position using the topography measuring device 680.

In S511, like the first embodiment, the stability determination section 702 acquires a stability determination threshold TH.

In S521, the stability determination section 702 performs stability determination. A measurement result obtained in S501 is illustrated in FIG. 17. The measurement result shows a measurement result in a site coordinate system X1Y1Z1 (for example, a reference point in a worksite is an origin, X1 is the eastward direction, Y1 is the northward direction, and Z1 is the vertically upward direction) that is tied to work locations. In the second embodiment, from this measurement result, an absolute value of the Z1 value is computed, and then it is determined whether all of the absolute values of this Z1 value are equal to or smaller than the threshold TH.

(1) When all of the absolute values of Z1 value are equal to or smaller than the threshold TH The processing in No. 3 stability determination (the stability determination section 702) ends, and No. 4 automated traveling toward the target position is restarted. That is, the automated traveling from a determination execution position (Tx2', Ty2') to a traveling target position (Tx2, Ty2) is executed.

(2) When there is a point with the absolute value of Z1 value larger than the threshold TH In S531, by executing automated leveling control (the automated leveling control section 705), an operation programmed in advance is performed to level the ground surface. Thereafter, No. 4 automated traveling toward the target position is restarted. That is, on the determination execution position (Tx2', Ty2'), the ground surface on the traveling target position (Tx2, Ty2) is leveled first, and then the automated traveling from the determination execution position (Tx2', Ty2') to the traveling target position (Tx2, Ty2) is executed.

As described above, in the automated control system of the hydraulic excavator 1 of the present embodiment, the stability determination section 702 determines the stability on the basis of a topography measurement result obtained by the topography measuring device 680 that measures a topography of the surrounding of the work machine.

In addition, when the stability determined by the stability determination section 702 is "not stable," the automated leveling control section 705 that levels the ground surface of the surrounding of the work machine is executed.

In this case, even if the ground is once determined to be unstable, it is possible to continue the automated control (without suspending the automated control) with ensured stability after leveling the surface of the ground.

In the automated control system of the excavator 1 with the above-described configuration, like the first embodiment, it is possible to reduce workability loss due to the automated control inadvertently started on an unstable ground.

Third Embodiment

The third embodiment will be described referring to FIG. 18 to FIG. 21.

In the third embodiment, unlike the first and second embodiments, the hydraulic excavator 1 includes a blade (not illustrated), and is configured to execute automated control for leveling the ground using the blade when the ground at a work location is determined to be unstable. On the hydraulic excavator 1, an operating device 22*c* for operating the blade is disposed.

The operating device 22*c* (see FIG. 18) is of an electric lever system, and generates an electrical signal corresponding to the amount and direction of the operation by an operator. The electrical signal thus generated is input to the controller 40, and the controller 40 outputs the electrical signal to the solenoid valve unit 160 to drive the proportional solenoid valves 56*a*, 56*b* (see FIG. 19) corresponding to the operation input to the operating device 22*c*. The proportional solenoid valve 56 receives the electrical signals, and the electrical signals are supplied to corresponding hydraulic drive sections 156*a*, 156*b* of flow rate control valve 15*g* via pilot lines 146*a*, 146*b* and used as control signals for driving the flow rate control valve 15*g*.

The pressure oil discharged from the hydraulic pump 2 is supplied to a blade cylinder 19 via the flow rate control valve 15*g*. With the pressure oil supplied, the blade cylinder 19 extends and retracts, whereby the blade rotatably moves, and the position and posture of the blade change.

The blade cylinder 19 includes pressure sensors 16*m*, 16*n* so as to detect an actuator pressure thereof. The pressure sensors 16*m*, 16*n* detect pressures on the bottom side and the rod side of the blade cylinder 19, and output the pressures as electrical signals to the controller 40 (in FIG. 18, connection lines from the pressure sensors 16*m*, 16*n* to the controller 40 are not illustrated due to spaces).

Figure 19:
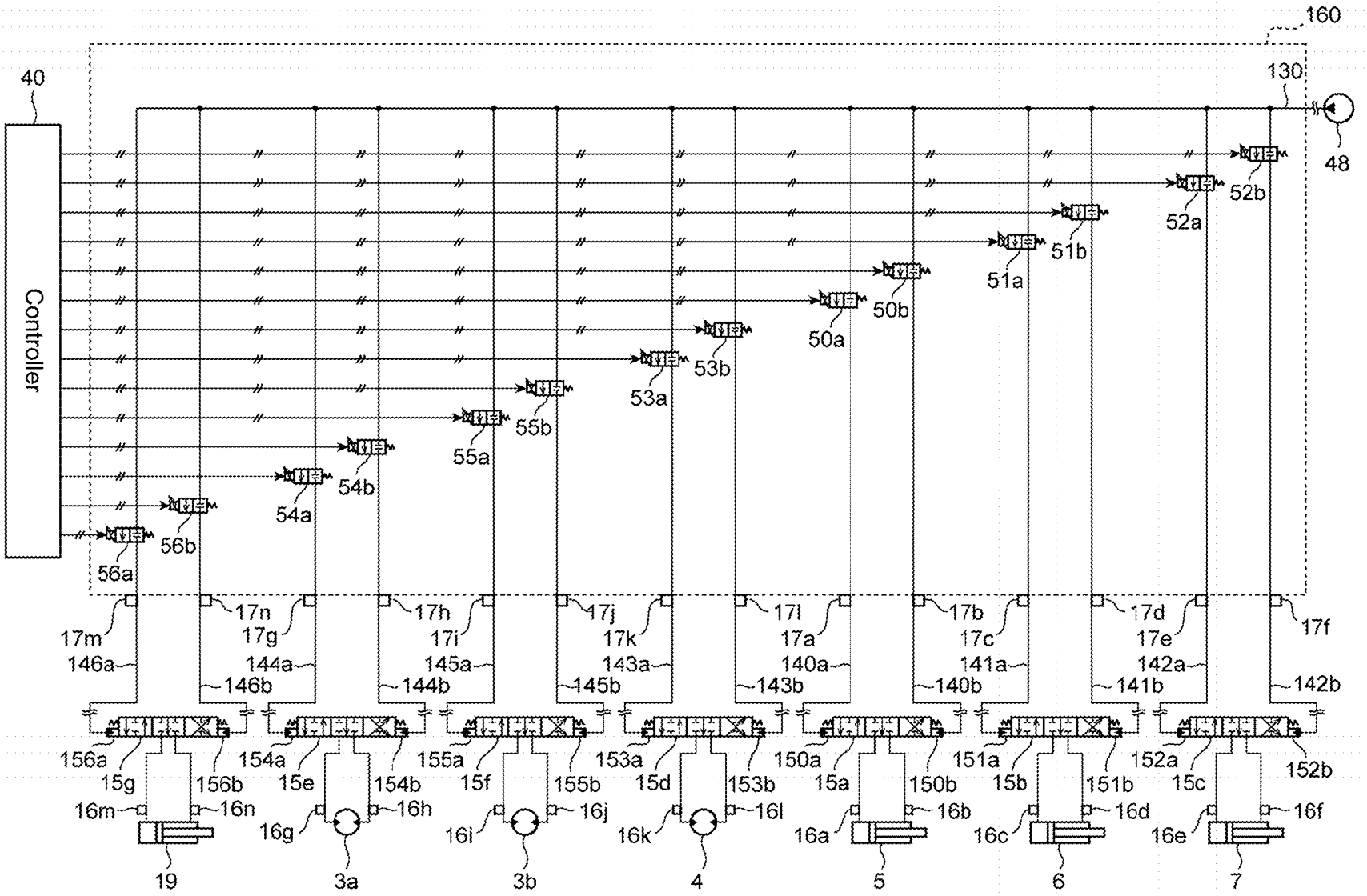
FIG. 19 is a detailed diagram of a solenoid valve unit of the third embodiment.

As illustrated in FIG. 19, the solenoid valve unit 160 includes proportional solenoid valves 56*a*, 56*b* that are connected, on a primary port side, to the pilot pump 48 via the pump line 130 and that output a pilot pressure from the pilot pump 48 to the pilot lines 146*a*, 146*b* while reducing the pilot pressure.

The pilot lines 146*a*, 146*b* are provided with pressure sensors 17*m*, 17*n* so as to detect output pressures of the proportional solenoid valve 56*a*, 56*b*.

Figure 20:
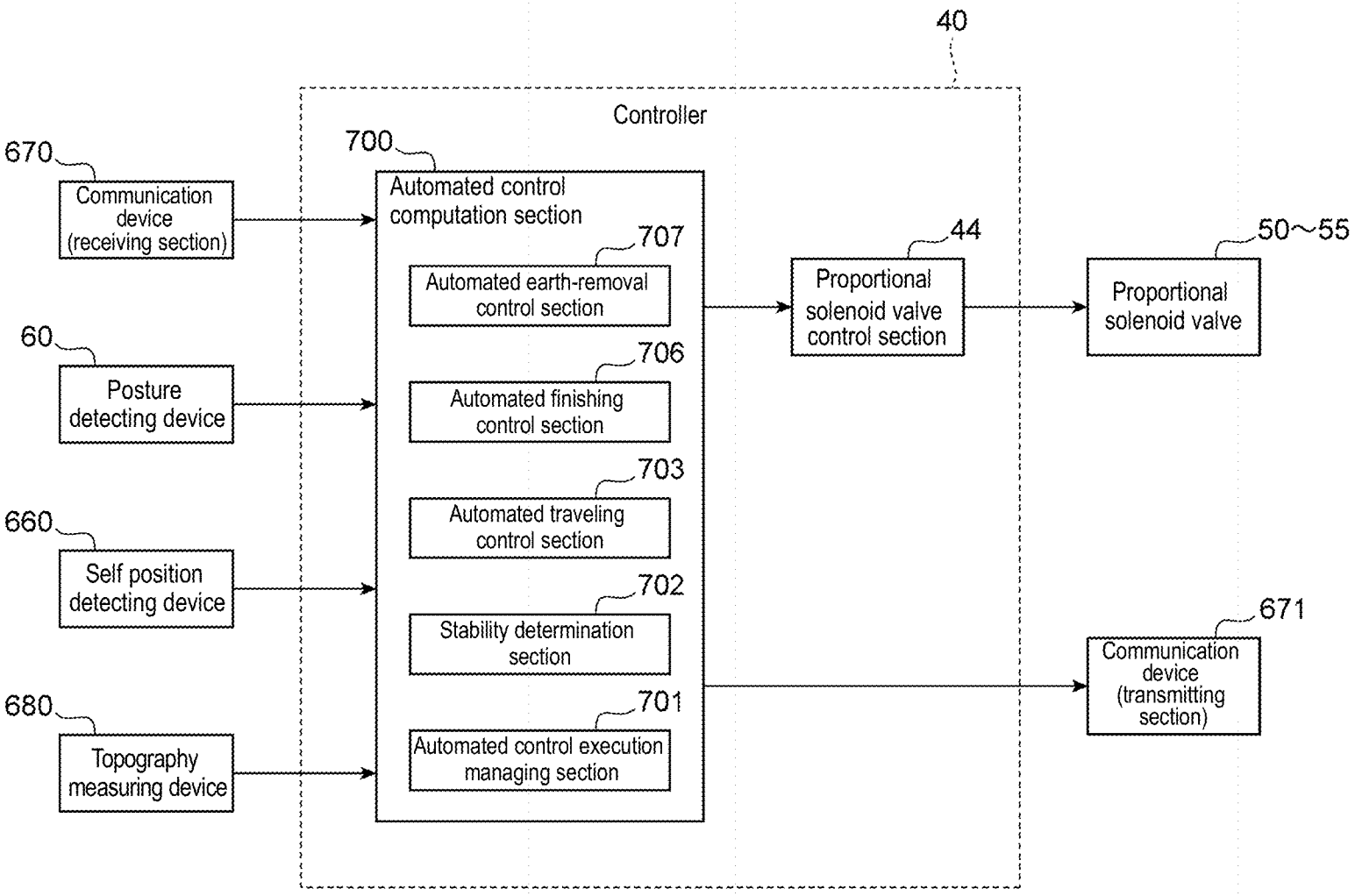
FIG. 20 is a functional block diagram of the controller of the third embodiment (during automated control).

FIG. 20 is a functional block diagram of the controller 40. FIG. 20 illustrates a functional block diagram executed when the control switching device 650 is in the automated control state (during automated driving that does not rely on the operation by the operator).

In the third embodiment, unlike the second embodiment, the automated control computation section 700 includes (instead of the automated excavation control section 704 and the automated leveling control section 705) an automated finishing control section (automated work control section) 706 and an automated earth-removal control section (automated leveling control section) 707.

The automated finishing control section (automated work control section) 706 is a control section that has a function similar to the automated excavation control section 704, but focuses more on the precision than the automated excavation control section 704, where a stricter threshold TH1 (<threshold TH) is set to the stability determination threshold.

The automated earth-removal control section (automated leveling control section) 707 performs an operation of leveling the ground surface of the surrounding of the hydraulic excavator 1 using the blade (instead of the bucket 10), and is configured to output target control pressures of the proportional solenoid valves 54 to 56 so as to perform a leveling operation that is programmed in advance, for example.

The third embodiment is similar to the second embodiment in that as a technique of stability evaluation, the stability determination is performed using a result of topography measurement obtained by the topography measuring device 680. In the third embodiment, since topography measurement is performed using the topography measuring device 680, like the second embodiment, the automated traveling control is divided and the stability determination is interposed (see FIG. 16).

Figure 21:
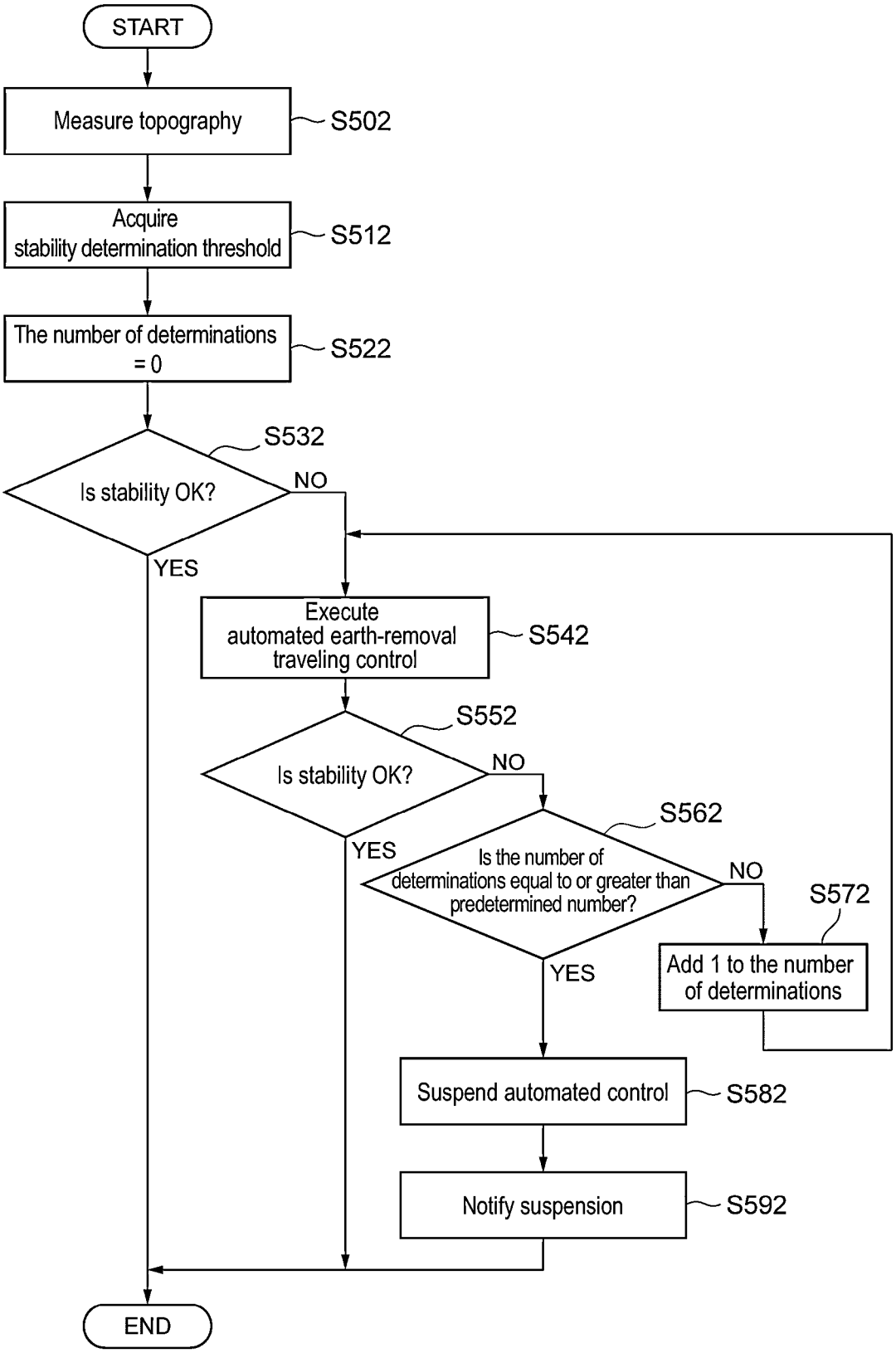
FIG. 21 is a control flowchart of a stability determination section 702 of the third embodiment.

The following describes details of the stability determination section 702 of the third embodiment referring to the control flowchart of FIG. 21.

In S502, the stability determination section 702 measures a topography on and in the vicinity of the traveling target position (the final target position) using the topography measuring device 680.

In S512, unlike the first and second embodiments, the stability determination section 702 acquires a stability determination threshold TH1 (<threshold TH).

In S522, the stability determination section 702 initializes a variable for counting the number of determinations in stability determination (set to 0).

In S532, like the second embodiment (S521), the stability determination section 702 performs stability determination. As a result of stability determination, when the stability is acceptable (when YES), the process ends. When the stability is not acceptable (when NO), control proceeds to S542.

In S542, automated earth-removal traveling control by the automated earth-removal control section 707 is executed. Through this, the ground surface on and in the vicinity of the traveling target position (the final target position) is leveled.

In S552, like S532, the stability determination section 702 performs stability determination. As a result of stability determination, when the stability is acceptable (when YES), the process ends. When the stability is not acceptable (when NO), control proceeds to S562.

In S562, the stability determination section 702 determines whether the number of determinations in stability determination (corresponding to the number of executions of automated earth-removal traveling control by the automated earth-removal control section 707) is equal to or greater than a predetermined number set in advance. When the number of determinations in stability determination is equal to or greater than the predetermined number (when YES), control proceeds to S582, and when the number of determinations in stability determination is less than the predetermined number (when NO), control proceeds to S572.

In S572, the stability determination section 702 adds 1 to the number of determinations in stability determination, and control proceeds to S542, where automated earth-removal traveling control by the automated earth-removal control section 707 is executed. Through this, until it is determined that the stability is acceptable, or until the number of determinations in stability determination (corresponding to the number of executions of automated earth-removal traveling control by the automated earth-removal control section 707) exceeds a predetermined number set in advance, automated earth-removal traveling control by the automated earth-removal control section 707 is repeatedly executed.

In S582, the automated control that has been registered in the step after the stability determination is suspended, and control proceeds to S592.

In S592, the suspension of automated control is notified to the external system via the communication device 671.

Operation and Effects

As described above, in the automated control system of the hydraulic excavator 1 of the present embodiment, the stability determination section 702 determines the stability on the basis of a topography measurement result obtained by the topography measuring device 680 that measures a topography of the surrounding of the work machine.

In addition, when the stability determined by the stability determination section 702 is "not stable," the automated leveling control section (the automated earth-removal control section 707) that levels the ground surface of the surrounding of the work machine is executed.

In the third embodiment, unlike the second embodiment, in S512, the stability determination section 702 acquires a threshold TH1 (<threshold TH) as a stability determination threshold, and in S532, when the stability is determined to be "not stable," leveling is performed in the automated earth-removal traveling control (using the blade) in S542. This allows starting the automated control on a more stable ground.

In the third embodiment, after leveling is performed in the automated earth-removal traveling control in S542, stability determination is performed again in S552, and the automated earth-removal traveling control is executed until the stability is determined to be "stable."

In addition, when the stability determined is "not stable" even after the predetermined number of executions of automated earth-removal traveling control, the automated control is suspended, and the suspension of automated control is notified to the external system via the communication device 671.

In the automated control system of the excavator 1 with the above-described configuration, like the first and second embodiments, it is possible to reduce workability loss due to the automated control inadvertently started on an unstable ground.

Fourth Embodiment

The fourth embodiment will be described referring to FIG. 22. In the fourth embodiment, unlike the second and third embodiments, the automated control system of the excavator 1 is basically configured to ensure stability of the ground without performing automated leveling control such as the automated leveling control using the bucket 10 or the automated earth-removal traveling control using the blade.

Figure 22:
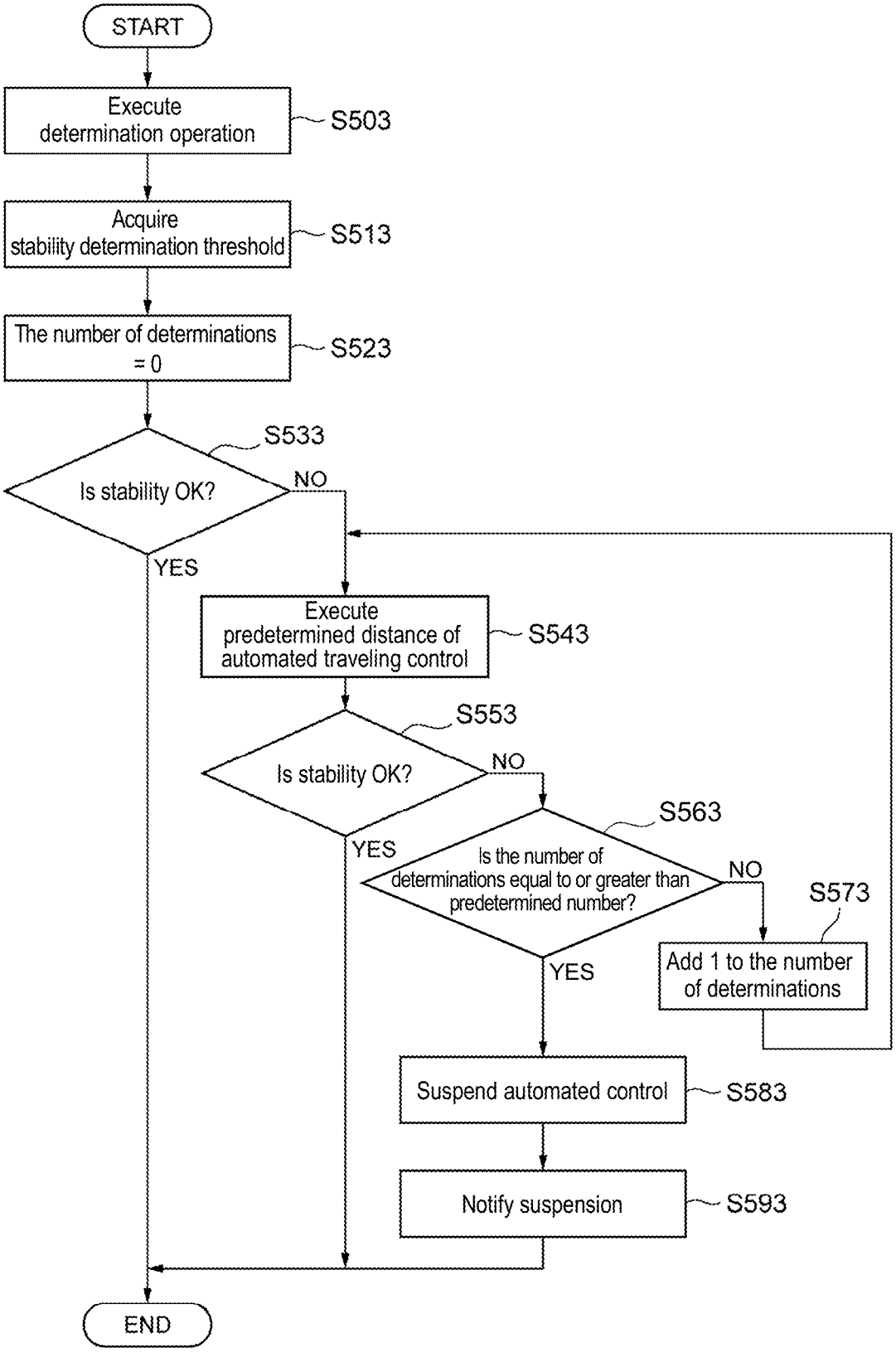
FIG. 22 is a control flowchart of a stability determination section 702 of a fourth embodiment.

The following describes details of the stability determination section 702 of the fourth embodiment referring to the control flowchart of FIG. 22.

In S503, like S500 of the first embodiment, the stability determination section 702 performs a determination operation. The following S513 is the same as S510 of the first embodiment, and S533 and S553 are the same as S520 of the first embodiment. S523, S563, S573, S583, and S593 are the same as S522, S562, S572, S582, and S592 of the third embodiment.

In S543, instead of the automated earth-removal traveling control (S542), automated traveling control (the automated traveling control section 703) corresponding to a direction and distance determined in advance is executed. In other words, in S543, automated traveling control (the automated traveling control section 703) is executed with a change in the traveling target position in the automated traveling control from an original position (by the direction and distance determined in advance). The predetermined direction and predetermined distance in S543 can be determined on the basis of the position where, even after moving the location, execution of the automated excavation control in the subsequent processing is possible, for example, on the basis of a bucket end (bucket tip) position P (see FIG. 4A and FIG. 4B) and the coordinates on a target position (see FIG. 11), and the like. Accordingly, without performing automated leveling control such as automated leveling control using the bucket 10 or automated earth-removal traveling control using the blade, it is possible to ensure stability of the ground only by simple automated control for performing a predetermined distance of automated traveling control.

Operation and Effects

As described above, in the automated control system of the hydraulic excavator 1 of the present embodiment, when the stability determined by the stability determination section 702 is "not stable," automated traveling control by the automated traveling control section 703 is executed with a change in the traveling target position in the automated traveling control section 703 from an original position.

In addition, an amount of change in the traveling target position in the automated traveling control section 703 is set on the basis of dimensions (e.g., the bucket end (bucket tip) position P) of the plurality of driven member.

That is, as illustrated in FIG. 22, in S533, when the stability is determined to be "not stable," a predetermined distance of automated traveling control is performed in S543. In addition, like the third embodiment, until it is determined that the stability is acceptable, or until the number of determinations in stability determination (corresponding to the number of executions of automated traveling control by the automated traveling control section 703) exceeds a predetermined number set in advance, automated traveling control by the automated traveling control section 703 is repeatedly executed. When the stability determined is "not stable" even after the predetermined number of executions of automated earth-removal traveling control (even if the number of executions of the automated traveling control section 703 exceeds the predetermined number set in advance), the automated control is suspended, and the suspension of automated control is notified to the external system via the communication device 671. This allows starting the automated control on a stable ground by simple automated control (automated traveling control).

In the automated control system of the excavator 1 with the above-described configuration, like the first to third embodiments, it is possible to reduce workability loss due to the automated control inadvertently started on an unstable ground.

In the first to fourth embodiments, although an angle sensor that detects an angle of the boom 8, the arm 9, and the bucket 10 is used, a cylinder stroke sensor, not the angle sensor, may be used to calculate posture information on the hydraulic excavator 1. While the hydraulic excavator 1 of an electric lever-type is described by way of example, an excavator of a hydraulic pilot type may be used, which is configured to control a command pilot pressure generated from a hydraulic pilot.

The above-described configurations of the controller 40, functions of the configurations, execution processing, and the like may be partially or entirely implemented by hardware (for example, by designing a logic executing each function with integrated circuitry, and the like). Alternatively, the above-described configuration of the controller 40 may be a program (software) that is read out and executed by an arithmetic processing device (e.g., CPU) so as to implement each function of the configurations of the controller 40. Information related to the program can be stored in, for example, a semiconductor memory (a flash memory, a SSD, etc.), a magnetic storage device (a hard disk drive, etc.) and a recording medium (a magnetic disc, an optical disc, etc.), or the like.

In the above-described first to fourth embodiments, while various examples of the stability determination method and the measure to be taken when the stability determined is "not stable" have been described, various combinations may be employed, in addition to the combinations described in the first to fourth embodiments.

As the stability determination technique of the first to fourth embodiments, stability is determined on the basis of whether the inclination angle $\phi$ of the upper turning body 12 obtained by the machine body inclination angle sensor 33 or the measurement value in the topography measurement by the topography measuring device 680 is within the range of the threshold TH (or threshold TH1) with respect to a reference. However, stability determination may be configured to compare a difference between a maximum value and a minimum value of the measurement data in a certain section with a threshold.

As the stability determination technique of the first embodiment, stability is determined using the inclination angle $\phi$ of the upper turning body 12 in the front-rear direction. However, stability may be determined using the inclination angle of the upper turning body 12 in the left-right direction, or stability may be determined using the inclination angle of the lower traveling body 11 in the front-rear direction or the inclination angle of the lower traveling body 11 in the left-right direction.

Now, variations of the stability evaluation method using the inclination angle $\phi$ will be added. In the above-described first embodiment, stability is determined using directly the value (absolute value) of the inclination angle $\phi$. However, stability may be determined using the following methods.

Modification Example 1 of the Stability Determination Method

Figure 23:
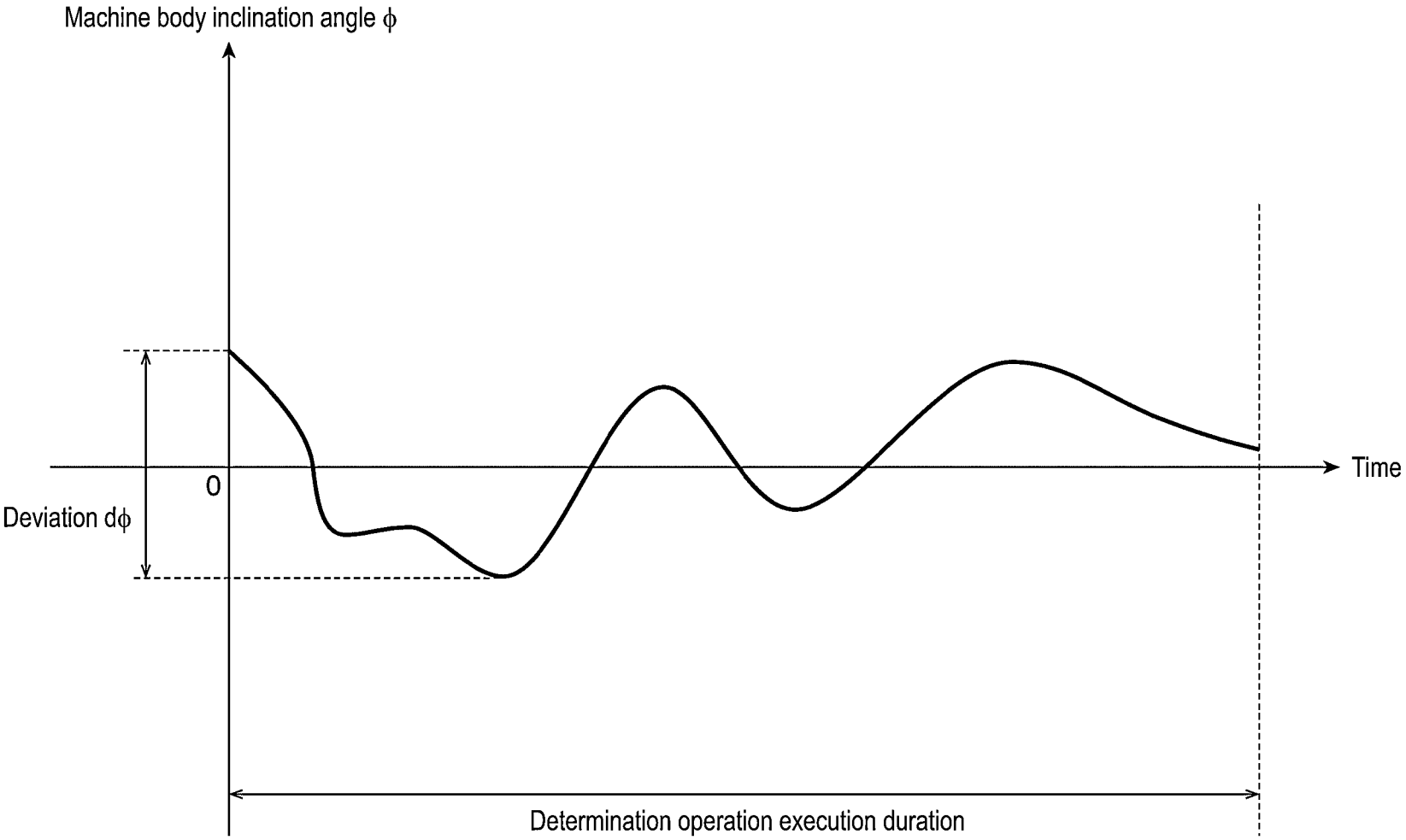
FIG. 23 is a graph illustrating a measurement result example of a machine body inclination angle ϕ for explaining Modification Example 1 of a stability determination method.

As in FIG. 23, for the inclination angle $\phi$ in the determination operation execution duration, the largest deviation $d\phi$ may be obtained from the inclination angle $\phi$ when the determination operation execution is started, and when this deviation $d\phi$ (absolute value) is greater than a predetermined threshold THm, it is determined that the stability is not acceptable, and when the deviation $d\phi$ (absolute value) is equal to or smaller than the threshold THm, it is determined that the stability is acceptable.

It is considered that the determination method using only an absolute angle, like the first embodiment, can determine stability on flat terrain. However, the validity of the determination may become lower when the ground surface is inclined, such as the case of sloped terrain. In this Modification Example 1 of the stability determination method, one can find an extra inclination with reference to the inclination angle $\phi$ when the determination operation execution is started, and thus it is considered that the validity of the determination on sloped terrain is improved. However, the inclination angle greatly varies by the turn on the sloped terrain, making it difficult to determine stability in the turning operation. It is considered that this Modification Example 1 of the stability determination method is preferably used in stability determination in the boom raising/lowering operation, for example.

Modification Example 2 of the Stability Determination Method

Figure 24:
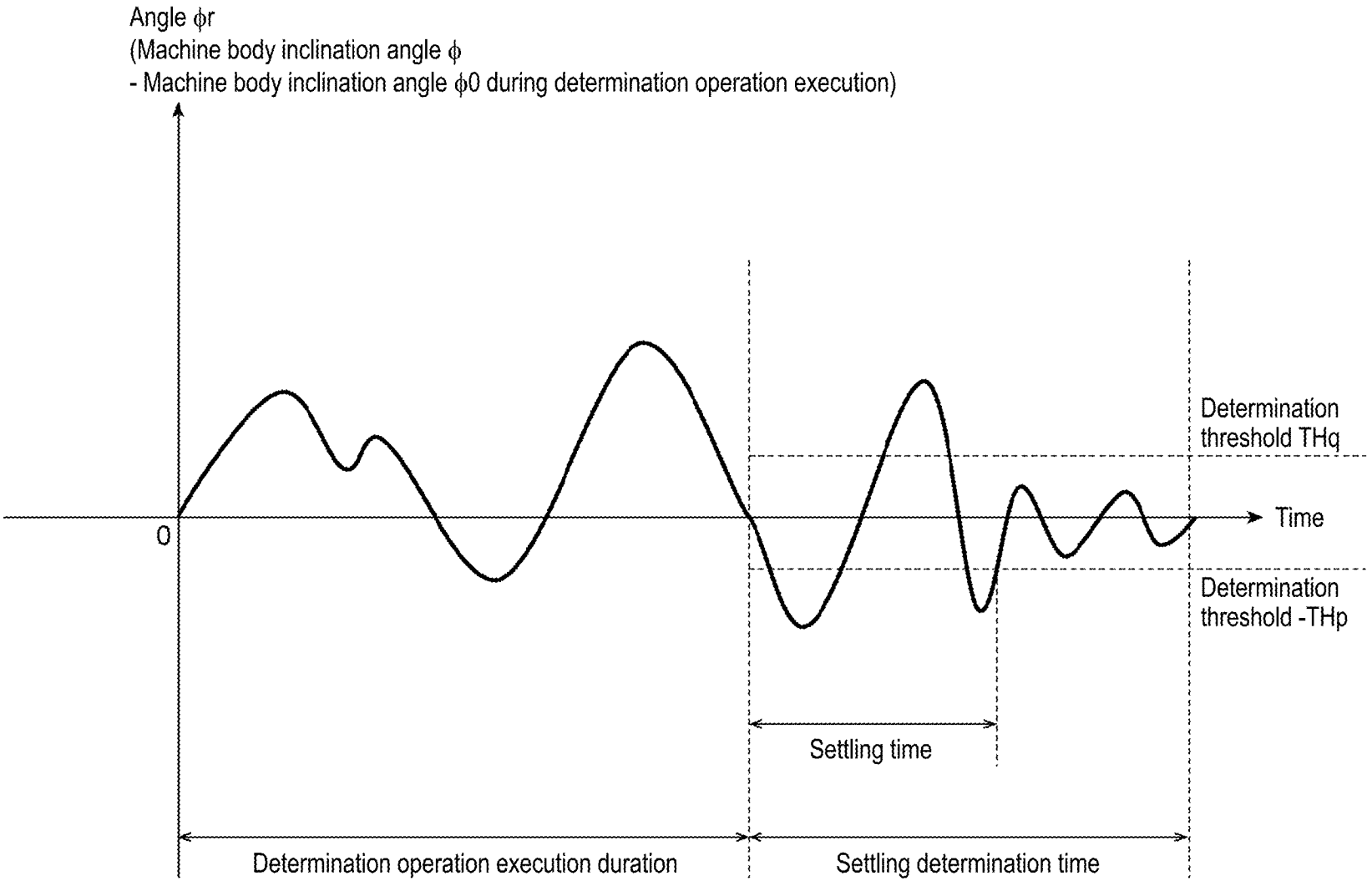
FIG. 24 is a graph illustrating a measurement result example of an angle ϕr (a machine body inclination angle ϕ—a machine body inclination angle ϕ0 during determination operation execution) for explaining Modification Example 2 of the stability determination method.

As in FIG. 24, after the determination operation execution duration, the inclination angle $\phi$ is measured for a section corresponding to a settling determination time that is set in advance. Note that the vertical axis in FIG. 24 is the angle $\phi r$ obtained by subtracting the inclination angle $\phi 0$ during determination operation execution from the inclination angle $\phi$. Of the settling determination time, an amount of time required for the angle $\phi r$ to fit in a range between a determination threshold −THp and a determination threshold THq is defined as a settling time. Stability is determined on the basis of whether this settling time is greater than a predetermined amount of time.

When the settling time is greater than the predetermined amount of time, it is determined that the stability is not acceptable, and when the settling time is equal to or smaller than the predetermined amount of time, it is determined that the stability is acceptable.

Note that in Modification Example 2 of the stability determination method, stability is determined on the basis of the settling time of the angle $\phi r$. However, the settling time may be determined using an angular velocity acquired by differentiation of the angle $\phi r$ or an angular acceleration acquired by differentiation of the angular velocity. In addition, the aforementioned angular velocity may be directly measured using, for example, a gyro sensor or the like.

In addition, an acceleration acquired from an acceleration sensor, instead of the angular acceleration, may be measured and used for the determination of the settling time.

In Modification Example 2 of the stability determination method, stability is determined on the basis of a dynamic behavior, and unlike Modification Example 1 of the stability determination method, stability determination is possible also in the turning operation.

Modification Example 3 of the Stability Determination Method

Among the first embodiment, Modification Example 1, Modification Example 2, and the variation of Modification Example 2 regarding the stability determination method, any combination may be used for stability evaluation. That is, it may be determined that the stability is acceptable only when all of the determination results show that the stability is acceptable, and it may be determined that the stability is not acceptable when at least one of the determination results shows that the stability is not acceptable.

In addition, the determination operation may be associated with one or more determination methods in advance, and stability may be determined on the basis of a determination result obtained by the determination method.

As a control parameter for executing automated traveling control, automated excavation control, and automated finishing control of the foregoing first to fourth embodiments, it is configured to execute control by receiving a target position. However, it may be configured such that an operation determined in advance is executed without requiring the control parameter, or as a control parameter, a parameter necessary for operating the hydraulic excavator 1 is received, such as a target control pressure of each proportional solenoid valve, a target angular velocity of an actuator, an angular velocity of each rotatably moving section, a velocity vector at a bucket tip position P or at a coupling pin position between the bucket 10 and the arm 9 or the like.

In the second and third embodiments, it is configured such that the automated leveling control or the automated earth-removal traveling control, which is automated control for leveling, is executed immediately after the stability is determined to be "not stable." However, it may be configured such that communication with the external system is performed, and automated leveling control is performed on the basis of a command from the external system.

In the fourth embodiment, it is configured such that, when the stability is determined to be "not stable," automated traveling corresponding to a predetermined direction and distance determined in advance is performed. However, it may be configured such that, for example, a location with a stable ground is estimated using the topography measuring device 680, and the automated traveling to the estimated location is performed.

In the first to fourth embodiments, the automated control computation section 700 that executes automated control of the hydraulic excavator 1 is mounted on the controller 40 of the hydraulic excavator 1. However, where to mount the automated control computation section 700 is not limited to this, and it is configured such that the automated control computation section 700 is mounted on an external system such as a cloud or a server, for example, and a signal is transmitted from the external system to the hydraulic excavator 1 via the communication device 670 to operate the hydraulic excavator 1.

It should be noted that the present invention is not limited to the aforementioned embodiments, and includes a variety of modifications. For example, although the aforementioned embodiments have been described in detail to clearly illustrate the present invention, the present invention need not include all of the configurations described in the embodiments. It is possible to replace a part of a configuration of an embodiment with a configuration of another embodiment. In addition, it is also possible to add, to a configuration of an embodiment, a configuration of another embodiment. Further, it is also possible to, for a part of a configuration of each embodiment, add, remove, or substitute a configuration of another embodiment.

REFERENCE SIGNS LIST

1 Hydraulic excavator (work machine)
1A Front work device
1B Machine body
8 Boom
9 Arm
10 Bucket
11 Lower traveling body
12 Upper turning body
16*a* to 16*l* Pressure sensor
17*a* to 17*l* Pressure sensor
22, 23 Operating device
30 Boom angle sensor
31 Arm angle sensor
32 Bucket angle sensor
33 Machine body inclination angle sensor (measuring device)
34 Turning angle sensor
40 Controller (control device)
44 Proportional solenoid valve control section
50, 51, 52, 53, 54, 55, 56 Proportional solenoid valve
60 Posture detecting device
470 Engine controller
480 Engine speed setting device
650 Control switching device
660 Self position detecting device
670 Communication device (receiving section)
671 Communication device (transmitting section)
680 Topography measuring device
700 Automated control computation section
701 Automated control execution managing section
702 Stability determination section
703 Automated traveling control section
704 Automated excavation control section (automated work control section)
705 Automated leveling control section
706 Automated finishing control section (automated work control section)
707 Automated earth-removal control section (automated leveling control section)

The invention claimed is:

1. An automated control system for a work machine, comprising:

a work machine including a lower traveling body, an upper turning body turnably attached to the lower traveling body, and a front work device that is rotatably supported on the upper turning body and is made up of a plurality of driven members that is driven by a plurality of actuators; and a control device that controls the work machine, wherein the control device includes:

an automated traveling control section that performs automated traveling of the work machine;

an automated excavation control section that performs automated excavation of the work machine; and a stability determination section that determines stability of ground for the work machine, and an automated control execution managing section that executes automated control of the work machine on the basis of an execution order of automated control including automated traveling of the work machine and automated excavation of the work machine, and wherein when execution of automated traveling by the automated traveling control section is to be followed by execution of automated excavation by the automated excavation control section in the execution order, the automated control execution managing section inserts execution of a determination operation by the stability determination section including at least one of a rotating operation of the front work device or a turning operation of the upper turning body between the automated traveling and the automated excavation, executes the automated control in accordance with the execution order in which the execution of the determination operation has been inserted, executes stability determination based on an inclination angle of the work machine measured during the execution of the determination operation, when stability is determined to be stable by the stability determination section, executes the automated excavation after the stability determination, and when stability is not determined to be stable by the stability determination section, suspends the automated control.

2. The automated control system for a work machine according to claim 1, wherein the stability determination section determines the stability on the basis of a stability determination threshold set in advance according to content of automated control that will be executed after stability determination is executed.

3. An automated control system for a work machine, comprising:

a work machine including a plurality of driven members that is driven by a plurality of actuators; and a control device that controls the work machine, wherein the control device includes:

an automated traveling control section that performs automated traveling of the work machine;

an automated work control section that performs automated work of the work machine; and a stability determination section that determines stability of ground for the work machine, wherein when execution of automated traveling control by the automated traveling control section is to be followed by execution of automated work control by the automated work control section, the control device executes stability determination by the stability determination section before executing the automated work control, and executes automated control of the work machine on the basis of a determination result obtained by the stability determination section, wherein the stability determination section determines the stability on the basis of a topography measurement result obtained by a topography measuring device that measures a topography of a surrounding of the work machine, wherein when the stability determination section determines that the stability is not stable, until it is determined that the stability is stable, or until a number of executions of an automated leveling control section that levels the topography of the surrounding of the work machine exceeds a predetermined number set in advance, the automated leveling control section is repeatedly executed, and wherein when the stability is not determined to be stable even after the number of executions of the automated leveling control section exceeds the predetermined number set in advance, automated control is suspended, and suspension is notified to an external system via a communication device that communicates with the external system.

4. The automated control system for a work machine according to claim 1, wherein when the stability determination section determines that the stability is not stable, automated traveling control by the automated traveling control section is executed with a change in a traveling target position in the automated traveling control section from an original position.

* * * * *